US007192092B2

(12) United States Patent
Watson

(10) Patent No.: US 7,192,092 B2
(45) Date of Patent: Mar. 20, 2007

(54) METHOD AND MEANS FOR RECOVERING HYDROCARBONS FROM OIL SANDS BY UNDERGROUND MINING

(75) Inventor: John David Watson, Evergreen, CO (US)

(73) Assignee: Oil Sands Underground Mining Corporation, Calgary (CA)

( * ) Notice: Subject to any disclaimer, the term of this patent is extended or adjusted under 35 U.S.C. 154(b) by 0 days.

(21) Appl. No.: 11/112,306

(22) Filed: Apr. 21, 2005

(65) Prior Publication Data

US 2005/0218711 A1 Oct. 6, 2005

Related U.S. Application Data

(62) Division of application No. 10/856,190, filed on May 28, 2004, now Pat. No. 7,128,375.

(60) Provisional application No. 60/475,947, filed on Jun. 4, 2003.

(51) Int. Cl.
*E21C 41/24* (2006.01)
*E21C 39/00* (2006.01)
*E21C 35/00* (2006.01)

(52) U.S. Cl. ..... 299/8; 299/57

(58) Field of Classification Search ..... 299/7, 299/8, 18, 57

See application file for complete search history.

(56) References Cited

U.S. PATENT DOCUMENTS 604,330 A 5/1898 Kibling
3,034,773 A 5/1962 Legatski
3,678,694 A 7/1972 Haspert
3,778,107 A 12/1973 Haspert
3,784,257 A 1/1974 Lauber et al.
3,888,543 A 6/1975 Johns
3,924,895 A * 12/1975 Leasure ..... 299/8
3,941,423 A 3/1976 Garte
3,960,408 A 6/1976 Johns
3,992,287 A * 11/1976 Rhys ..... 209/3.1
4,055,959 A 11/1977 Fritz
4,067,616 A 1/1978 Smith et al.
4,072,018 A 2/1978 Alvarez-Calderon (Continued)

FOREIGN PATENT DOCUMENTS

CA 986146 3/1976

(Continued)

OTHER PUBLICATIONS

Babendererde et al., "Extruded Concrete Lining—The Future Lining Technology for Industrialized Tunnelling," 2001 RETC Proceedings, Chapter 55, pp. 679-685.

(Continued)

*Primary Examiner*—John Kreck
(74) *Attorney, Agent, or Firm*—Sheridan Ross P.C.

(57) ABSTRACT

The present invention is directed generally to the combined use of slurry mining and hydrocyclones to recover hydrocarbons, such as bitumen, from hydrocarbon-containing materials, such as oil sands, and to selective mining of valuable materials, particularly hydrocarbon-containing materials, using a plurality of excavating devices and corresponding inputs for the excavated material. The excavated material captured by each input can be switched back-and-forth between two or more destinations depending on the value of the stream.

19 Claims, 20 Drawing Sheets

U.S. PATENT DOCUMENTS

| | | | | |
|---|---|---|---|---|
| 4,099,388 | A | 7/1978 | Husemann et al. | |
| 4,116,487 | A | 9/1978 | Yamazaki et al. | |
| 4,152,027 | A | 5/1979 | Fujimoto et al. | |
| 4,167,290 | A | 9/1979 | Yamazaki et al. | |
| 4,203,626 | A | 5/1980 | Hamburger | |
| 4,209,268 | A | 6/1980 | Fujiwara et al. | |
| 4,216,999 | A | 8/1980 | Hanson | |
| 4,236,640 | A * | 12/1980 | Knight | 209/587 |
| 4,440,449 | A | 4/1984 | Sweeney | |
| 4,445,723 | A | 5/1984 | McQuade | |
| 4,455,216 | A | 6/1984 | Angevine et al. | |
| 4,458,947 | A | 7/1984 | Hopley et al. | |
| 4,486,050 | A | 12/1984 | Snyder | |
| 4,494,799 | A | 1/1985 | Snyder | |
| 4,505,516 | A | 3/1985 | Shelton | |
| 4,603,909 | A | 8/1986 | LeJeune | |
| 4,607,889 | A | 8/1986 | Hagimoto et al. | |
| 4,699,709 | A | 10/1987 | Peck | |
| 4,774,470 | A | 9/1988 | Takigawa et al. | |
| 4,793,736 | A | 12/1988 | Thompson et al. | |
| 4,808,030 | A | 2/1989 | Takegawa | |
| 4,856,936 | A | 8/1989 | Hentschel et al. | |
| 4,911,578 | A | 3/1990 | Babendererde | |
| 4,946,597 | A | 8/1990 | Sury | |
| 5,051,033 | A | 9/1991 | Grotenhofer | |
| 5,125,719 | A | 6/1992 | Snyder | |
| 5,141,363 | A | 8/1992 | Stephens | |
| 5,174,683 | A | 12/1992 | Grandori | |
| 5,205,613 | A | 4/1993 | Brown, Jr. | |
| 5,211,510 | A | 5/1993 | Kimura et al. | |
| 5,316,664 | A | 5/1994 | Gregoli et al. | |
| 5,330,292 | A | 7/1994 | Sakanishi et al. | |
| 5,534,136 | A | 7/1996 | Rosenbloom | |
| 5,697,676 | A | 12/1997 | Kashima et al. | |
| 5,831,934 | A | 11/1998 | Gill et al. | |
| 5,852,262 | A | 12/1998 | Gill et al. | |
| 5,879,057 | A | 3/1999 | Schwoebel et al. | |
| 5,890,771 | A | 4/1999 | Cass | |
| 6,003,953 | A | 12/1999 | Huang et al. | |
| 6,017,095 | A | 1/2000 | DiMillo | |
| 6,027,175 | A | 2/2000 | Seear et al. | |
| 6,206,478 | B1 | 3/2001 | Uehara et al. | |
| 6,364,418 | B1 * | 4/2002 | Schwoebel | 299/17 |
| 6,554,368 | B2 | 4/2003 | Drake et al. | |
| 2002/0030398 | A1 * | 3/2002 | Drake et al. | 299/8 |
| 2003/0038526 | A1 | 2/2003 | Drake et al. | |
| 2003/0160500 | A1 | 8/2003 | Drake et al. | |
| 2004/0070257 | A1 | 4/2004 | Drake et al. | |

FOREIGN PATENT DOCUMENTS

| | | |
|---|---|---|
| CA | 986544 | 3/1976 |
| CA | 1165712 | 4/1984 |
| CA | 1167238 | 5/1984 |
| CA | 2124199 | 11/1991 |
| CA | 2222668 | 11/1997 |
| CA | 2315596 | 5/2000 |
| CA | 2332207 | 1/2001 |
| CA | 2358805 | 1/2001 |
| WO | WO 01/69042 A1 | 9/2001 |

OTHER PUBLICATIONS

Becker, C., The Fourth Tube of the Elbe-Tunnel—Built by the World's Largest Soft Ground Tunnelling Machine, 2001 RETC Proceedings, Chapter 17, pp. 182-186.

Becker, C., "Recent Application of Slurry- and EPB-Technique in Europe," 1999 RETC Proceedings, Chapter 48, pp. 857-864.

Becker, C., "The Choice Between EPB- and Slurry Shields: Selection Criteria by Practical Examples," 1995 RETC Proceedings, Chapter 31, pp. 479-492.

Bergling et al., "Main Bearings for Advanced TBMS," 1995 RETC Proceedings, Chapter 32, pp. 493-508.

Borm, G., "Integrated Seismic Imaging System for Geological Prediction Ahead in Underground Construction," 2001 RETC Proceedings, Chapter 22, pp. 263-271.

Canadian Heavy Oil Associate (CHOA) Annual Conference; *Oil Sands Underground Mining; Inc.*; Dec. 6, 2000.

"Canadian Coal Given the TBM treatment at Cape Breton"; Reprinted from *Tunnels & Tunnelling*, May 1985; 4 pgs.

Corti et al., "Athabasca Mineable Oil Sands: The RTR/Gulf Extraction Process Theoretical Model of Bitumen Detachment," The 4th UNITAR/UNDP International Conference on Heavy Crude and Tar Sands Proceedings, vol. 5, Edmonton, AB, Aug. 7-12, 1988, pp. 41-44, 71.

Dowden et al., "Coping with Boulders in Soft Ground TBM Tunneling," 2001 RETC Proceedings, Chapter 78, pp. 961-977.

Doyle et al., "Construction of Tunnels in Methane Environments," 1991 RETC Proceedings, Chapter 12, pp. 199-224.

Drake, R., "An Innovative Approach for the Underground Mining of Oil Sands," presented at North American Tunneling 2002, Seattle, WA May 2002 and NARMS-TAC 202, Mining and Tunneling Innovation and Opportunity Conference, Toronto, Ontario, Jul. 2002, 8 pages.

Drake et al., "A Promising New Concept for Underground Mining of Oil Sands," technical papers presented to Canadian Institute of Mining (CIM), Ft. McMurray, Jun. 13-15, 2001, pp. 1-16.

Friesen et al.; "Monitoring of Oil Sand Slurries by On-linw NIR Spectroscopy"; Petroleum Society of CIM & Aostra; paper No. 94. 10; 9 pages.

Funasaki et al., "World's Largest Slurry Shield Tunneling Report in Trans-Tokyo Bay Highway Construction," 1997 RETC Proceedings, Chapter 36, pp. 591-604.

Guetter et al., "Two Tunnels in Totally Different Geological Formations Driven by the Same 7M Double-Shield TMB with an Extremely Thin-Walled Monoshell Honeycomb Segmental Lining System," 2001 RETC Proceedings, Chapter 21, pp. 241-260.

Harris et al.; "FeasibilityStudy of Underground Mining of Oil Sand"; AOSTRA Seminar on Underground excavation in Oil Sands; May 19, 1978; 33 pages.

Herrenknecht et al., "The New Generation of Soft Ground Tunneling Machines," 1999 RETC Proceedings, Chapter 36, pp. 647-663.

Higashide et al., "Application of DOT Tunneling Method to Construction of Multi-Service Utility Tunnel Adjacent to Important Structures," 1995 RETC Proceedings, Chapter 34, pp. 527-541.

Hignett et al.; "Tunnelling Trials in Chalk: Rock Cutting Experiments"; *TRRL Laboratory Report 796*; 1977.

Hunter et al.; "Design, development, and verification of a Lovat 7.6-metre full-face tunnel-boring machine"; *CIM Coal Developments*; 8 pages.

"In Focus: Sunburst Excavation"; *World Mining Equipment*; Nov. 1993; pp. 18, 19, 22, and 23.

"Improving Profitability With New Technology," Joint Paper Between Petrel Robertson and Oil Sands Underground Mining, Inc., Edmonton, Alberta, Sep. 2001, 44 pages.

Jacobs et al.,"Hydrogen Sulfide Controls for Slurry Shield Tunneling in Gassy Ground Conditions—A Case History," 1999 RETC Proceedings, pp. 221-239.

Liu et al.; "Volume reduction of oil sands fine tails utilizing nonsegregating tailings"; *Tailings and Mine Waste* '96; pp. 73-81.

Lovat Inc. Company Brochure.

Maciejewski; "Hydrotransport—An Enabling Technology for Future Oil Sands Development"; Syncrude Canada Ltd.; pp. 67-79.

Marcheselli et al., "Construction of the 'Passante Ferroviarlo' Link in Milano, Lots 3P-5P-6P Excavation by Large Earth Pressure Balanced Shield with Chemical Foam Injection," 1995 RETC Proceedings, Chapter 36, pp. 549-572.

Marsh et al.; "Design, Excavation, Support of a Large Diameter Coal Mine Access Decline Using a Tunnel Boring Machine"; Chapter 11; *RETC Proceedings*, vol. 1; pp. 155-176.

Matthews et al.; "Development of composite tailings technology at Syncrude Canada"; Syncrude EDM Research; 2000; pp. 455-463.

McCormick et al.; Analysis of TBM Performance at the Record Setting River Mountains Tunnel #2; Chapter 8; 1997 *RETC Proceedings*; pp. 135-149.
Mikula et al.; "Oil Sands Conditioning, Bitumen Release Mechanisms, and New Process Development"; Alberta Oil Sands Information Services; 1993; 8 pgs.
Mikula et al.; "Commercial Implementation of a Dry Landscape Oil Sands Tailings Reclamation Option: Consolidated Tailings"; Alberta Oil Sands Information Services; No. 1998.096; pp. 907-921.
Mitsubishi Shield Machine Article: by Mitsubishi Heavy Industries, Ltd.; 33 pages.
Moulton et al., "Tunnel Boring Machine Concept for Converging Ground," 1995 RETC Proceedings, Chapter 33, pp. 509-523.
Oil Sands Underground Mining Inc., "Underground Mining of Oil Sands," presented at National Oil Sands Task Force, Jan. 2001 Quarterly Meeting, 38 pages.
Oil Sands Underground Mining, Inc., "A New Technology for the Recovery of Oil Sands," presented at combined Oil Sands Task Force and Black Oil Pipeline Network Meeting, Jun. 2001, 30 pages.
Oil Sands Underground Mining, Inc., "A Private Sector Approach to Design/Build," presented at NAT 2002, 34 pages.
Ounanian et al.; "Development of an Extruded Tunnel Lining System" Chapter 81; 1981 *RETC Proceedings* vol. 2; pp. 1333-1351.
Ozdemir et al.; Development of a Water Jet Assisted Drag Bit cutting Head for Coal Measure Rock Chapter 41; RETC Proceedings, vol. 2; 1983; pp. 701-718.
Paine et al.; "Understanding hydrotransport: The key to Syncrude's success"; *CIM Bulletin*; vol. 92; 1999; pp. 105-108.
Peer; "Giant rock TBM to drive access tunnels under ocean"; reprinted from *Heavy Construction News*; Sep. 19, 1983; 2 pgs.
Press Release; Slurries.wpd; Jan Czarnecki; 3 pages.
Richards et al., "Slurry Shield Tunnels on the Cairo Metro," 1997 RETC Prooeedings, Chapter 44, pp. 709-733.
Rose, D., "Steel-Fiber-Reinforced-Shotcrete for Tunnels: An International Update," 1999 RETC Proceedings, pp. 525-536.
Sager, H., "Underpassing the Westerschelde by Implementing New Technologies," 1999 RETC Proceedings, pp. 927-938.
Stack; "Handbook of Mining and Tunneling Machinery"; *John Wiley & Sons*; (1982) p. 283 and 310.
Stokes et al.; "Cutting head ventilation of a full face tunnel boring machine"; Cape Breton Coal Research Laboratory, CANMET, Sydney, Canda; pp. 305-311.
Uchiyama, S., "Twin TBM with Four Cutters for Subway Station (Roppongi Station in the Tokyo Metro Line 12)," 1999 RETC Proceedings, Chapter 37, pp. 665-674.
Wang et al.; "High Pressure Water Jet Assisted Tunnelling" Chapter 34; 1976 *RETC Proceedings*; pp. 649-676.
Wu et al., "Stress Analysis and Design of Tunnel Linings," Chapter 26, pp. 431-455.
Yoshidawa et al.; "A Study of Shield Tunnelling Machine (Part 1)—Soil Condition for Pressurized Slurry Shield to be Adapted-"; Translation Copy of Hitachi Zosen Technical Review; vol. 42; No. 1-4; 1981; 38 pages.
Young et al.; "Full-scale Testing of the PCF Rock Excavation Method"; *VIII Australian Tunnelling Conference*; Aug. 1993. pp. 259-264.

* cited by examiner

METHOD AND MEANS FOR RECOVERING HYDROCARBONS FROM OIL SANDS BY UNDERGROUND MINING

CROSS REFERENCE TO RELATED APPLICATION

The present application is a divisional of U.S. patent application Ser. No. 10/856,190 filed May 28, 2004, entitled "METHOD AND MEANS FOR RECOVERING HYDROCARBONS FROM OIL SANDS BY UNDERGROUND MINING", now U.S. Pat. No. 7,128,375 which claims the benefits of U.S. Provisional Application Ser. No. 60/475,947 filed Jun. 4, 2003, each of which is incorporated herein by reference.

FIELD OF INVENTION

The present invention relates generally to a method and system for excavating oil sands material and specifically for extracting bitumen or heavy oil from oil sands inside or nearby a shielded underground mining machine.

BACKGROUND OF THE INVENTION

There are substantial deposits of oil sands in the world with particularly large deposits in Canada and Venezuela. For example, the Athabasca oil sands region of the Western Canadian Sedimentary Basin contains an estimated 1.3 trillion bbls of potentially recoverable bitumen. There are lesser, but significant deposits, found in the U.S. and other countries. These oil sands contain a petroleum substance called bitumen or heavy oil. Oil Sands deposits cannot be economically exploited by traditional oil well technology because the bitumen or heavy oil is too viscous to flow at natural reservoir temperatures.

When oil sand deposits are near the surface, they can be economically recovered by surface mining methods. The bitumen is then retrieved by an the extraction process and finally taken to an upgrader facility where it is refined and converted into crude oil and other petroleum products.

The Canadian oil sands surface mining community is evaluating advanced surface mining machines that can excavate material at an open face and process the excavated oil sands directly into a dirty bitumen froth. If such machines are successful, they could replace the shovels and trucks, slurry conversion facility, long hydrotransport haulage and primary bitumen extraction facilities that are currently used.

When oil sand deposits are too far below the surface for economic recovery by surface mining, bitumen can be economically recovered in many but not all areas by recently developed in-situ recovery methods such as SAGD (Steam Assisted Gravity Drain) or other variants of gravity drain technology which can mobilize the bitumen or heavy oil.

Roughly 65% or approximately 800 billion barrels of the bitumen in the Athabasca cannot be recovered by either surface mining or in-situ technologies. A large fraction of these currently inaccessible deposits are too deep for recovery by any known technology. However, there is a considerable portion that are in relatively shallow deposits where either (1) the overburden is too thick and/or there is too much water-laden muskeg for economical recovery by surface mining operations; (2) the oil sands deposits are too shallow for SAGD and other thermal in-situ recovery processes to be applied effectively; or (3) the oil sands deposits are too thin (typically less than 20 meters thick) for use efficient use of either surface mining or in-situ methods.

Estimates for economical grade bitumen in these areas range from 30 to 100 billion barrels.

Some of these deposits may be exploited by an appropriate underground mining technology. Although intensely studied in the 1970s and early 1980s, no economically viable underground mining concept has ever been developed for the oil sands. In 2001, an underground mining method was proposed based on the use of large, soft-ground tunneling machines designed to backfill most of the tailings behind the advancing machine. A description of this concept is included in U.S. Pat. No. 6,554,368 "Method And System for Mining Hydrocarbon-Containing Materials" which is incorporated herein by reference. One embodiment of the mining method envisioned by U.S. Pat. No. 6,554,368 involves the combination of slurry TBM or other fully shielded mining machine excavation techniques with hydrotransport haulage systems as developed by the oil sands surface mining industry. In another embodiment, the bitumen may be separated inside the TBM or mining machine by any number of various extraction technologies.

In mining operations where an oil sands ore is produced, there are several bitumen extraction processes that are either in current use or under consideration.

These include the Clark hot water process which is discussed in a paper "Athabasca Mineable Oil Sands: The RTR/Gulf Extraction Process—Theoretical Model of Detachment" by Corti and Dente which is incorporated herein by reference. The Clark process has disadvantages, some of which are discussed in the introductory passage of U.S. Pat. No. 4,946,597 which is incorporated herein by reference, notably a requirement for a large net input of thermal and mechanical energy, complex procedures for separating the released oil, and the generation of large quantities of sludge requiring indefinite storage.

The Corti and Dente paper suggests that better results should be obtained with a proper balance of mechanical action and heat application. Canadian Patent 1,165,712 which is incorporated herein by reference, points out that more moderate mechanical action will reduce disaggregation of the clay content of the sands. Separator cells, ablation drums, and huge inter-stage tanks are typical of apparatuses necessary in oil sands extraction. An example of one of these is the Bitmin drum or counter-current desander CCDS. Canadian Patent 2,124,199 "Method and Apparatus for Releasing and Separating Oil from Oil Sands" describes a process for separating bitumen from its sand matrix form and feedstock of oil sands.

Another oil sands extraction method is based on cyclo-separators (also known as hydrocyclones) in which centrifugal action is used to separate the low specific gravity materials (bitumen and water) from the higher specific gravity materials (sand, clays etc).

Canadian Patent 2,332,207 describes a surface mining process carried in a mobile facility which consists of a surface mining apparatus on which is mounted an extraction facility comprised of one or more hydrocyclones and associated equipment. The oil sands material is excavated by one or more cutting heads, sent through a crusher to remove oversized ore lumps and then mixed with a suitable solvent such as water in a slurry mixing tank. The slurry is fed into one or more hydrocylcones. Each hydrocyclone typically separates about 70% of the bitumen from the input feed. Thus a bank of three hydrocylcones can be expected to separate as much as 95% of the bitumen from the original ore. The product of this process is a dirty bitumen stream that is ready for a froth treatment plant. The waste from this process is a tailings stream which is typically less than 15% by mass water. The de-watered waste produced by this process may be deposited directly on the excavated surface without need for large tailings ponds, characteristic of current surface mining practice.

In a mining recovery operation, the most efficient way to process oil sands is to excavate and process the ore as close to the excavation face as possible. If this can be done using an underground mining technique, then the requirement to remove large tracts of overburden is eliminated. Further, the tailings can be placed directly back in the ground thereby substantially reducing a tailings disposal problem. The extraction process for removing the bitumen from the ore requires substantial energy. If a large portion of this energy can be utilized from the waste heat of the excavation process, then this results in less overall greenhouse emissions. In addition, if the ore is processed underground, methane liberated in the process can also be captured and not released as a greenhouse gas.

There is thus a need for a bitumen/heavy oil recovery method in oil sands that can be used to:

a) extend mining underground to substantially eliminate overburden removal costs;

b) avoid the relatively uncontrollable separation of bitumen in hydrotransport systems;

c) properly condition the oil sands for further processing underground, including crushing;

d) separate most of the bitumen from the sands underground inside the excavating machine;

e) produce a bitumen slurry underground for hydrotransport to the surface;

f) prepare waste material for direct backfill behind the mining machine so as to reduce the haulage of material and minimize the management of tailings and other waste materials;

g) reduce the output of carbon dioxide and methane emissions released by the recovery of bitumen from the oil sands; and h) utilize as many of the existing and proven engineering and technical advances of the mining and civil excavation industries as possible.

SUMMARY OF THE INVENTION

These and other needs are addressed by the various embodiments and configurations of the present invention. The present invention is directed generally to the combined use of underground slurry mining techniques and hydrocyclones to recover hydrocarbons, such as bitumen, from hydrocarbon-containing materials, such as oil sands, and to selective underground mining of valuable materials, particularly hydrocarbon-containing materials. As used herein, a "hydrocyclone" refers to a cyclone that effects separation of materials of differing densities and/or specific gravities by centrifugal forces, and a "hydrocyclone extraction process" refers to a bitumen extraction process commonly including one or more hydrocyclones, an input slurry vessel, a product separator, such as a decanter, to remove solvent from one of the effluent streams and a solvent removal system, such as a dewatering system, to recover solvent from another one of the effluent streams.

In a first embodiment of the present invention, a method for excavating a hydrocarbon-containing material is provided. The method includes the steps of:

(a) excavating the hydrocarbon-containing material with an underground mining machine, with the excavating step producing a first slurry including the excavated hydrocarbon-containing material and having a first slurry density, (b) contacting the first slurry with a solvent such as water to produce a second slurry having a second slurry density lower than the first slurry density;

(c) hydrocycloning, using one or more hydrocyclones, the second slurry to form a first output including at least most of the hydrocarbon content of the excavated hydrocarbon-containing material; a second output including at least most of the solid content of the first slurry, and a third output including at least most of the solvent content of the second slurry; and (d) backfilling the underground excavation behind the mining machine with at least a portion of the second output to form a trailing access tunnel having a backfilled (latitudinal) cross-sectional area that is less than the pre-backfilled (latitudinal) cross-sectional area of the excavation before backfilling.

The hydrocarbon-containing material can be any solid hydrocarbon-containing material, such as coal, a mixture of any reservoir material and oil, tar sands or oil sands, with oil sands being particularly preferred. The grade of oil sands is expressed as a percent by mass of the bitumen in the oil sand. Typical acceptable bitumen grades for oil sands are from about 6 to about 9% by mass bitumen (lean); from about 10 to about 11% by mass (average), and from about 12 to about 15% by mass (rich).

The underground mining machine can be any excavating machinery, whether one machine or a collection of machines. Commonly, the mining machine is a continuous tunneling machine that excavates the hydrocarbon-containing material using slurry mining techniques. The use of underground mining to recover hydrocarbon-containing material can reduce substantially or eliminate entirely overburden removal costs and thereby reduce overall mining costs for deeper deposits and take advantage of existing and proven engineering and technical advances in mining and civil excavation.

The relative densities and percent solids content of the various slurries can be important for reducing the requirements for makeup solvent; avoiding unnecessary de-watering steps; minimizing energy for transporting material; and minimizing energy for extracting the valuable hydrocarbons. Preferably, the first slurry density ranges from about 1,100 kilograms per cubic meter to about 1,800 kilograms per cubic meter and the second slurry density ranges from about 1,250 kilograms per cubic meter to about 1,500 kilograms per cubic meter corresponding to about 30 to about 50% solids content by mass.

Backfilling provides a cost-effective and environmentally acceptable method of disposing of a large percentage of the tailings. For example, the backfilled cross-sectional area is no more than about 50% of the pre-backfilled cross-sectional area. The cross-sectional area of the underground excavation and/or trailing access tunnel is/are measured transverse to a longitudinal axis (or direction of advance) of the excavation. Backfilling can reduce the haulage of material and minimize the management of tailings and other waste materials.

Due to the high separation efficiency of multiple stage hydrocycloning, the various outputs include high levels of desired components. The first output comprises no more than about 20% of the solvent content of the second slurry, the second output comprises no more than about 35% of the solvent content of the second slurry; and the third output comprises at least about 50% of the solvent content of the second slurry. There is normally a de-watering step at the end of a multiple stage hydrocycloning extraction process for recovery of solvent. The first output comprises no more than about 10% of the solids content of the second slurry, the second output comprises at least about 70% of the solids content of the second slurry; and the third output comprises no more than about 15% of the solids content. The first output comprises at least about 70% of the bitumen content of the second slurry, the second output comprises no more than about 10% of the bitumen content of the second slurry, and the third output comprises no more than about 10% of the bitumen content of the second slurry. The second output is often of a composition that permits use directly in the backfilling step. This enables backfilling typically to be performed directly after hydrocycloning.

To provide a higher hydrocycloning efficiency, the first slurry is preferably maintained at a pressure that is at least about 75% of the formation pressure of the excavated hydrocarbon-containing material before excavation. When introduced into the hydrocycloning step, the pressure of the second slurry is reduced to a pressure that is no more than about 50% of the formation pressure. The sudden change in pressure during hydrocycloning can cause gas bubbles already trapped in the hydrocarbon-containing material to be released during hydrocycloning. As will be appreciated, gas bubbles (which are typically methane and carbon dioxide) are trapped within the component matrix of oil sands at high formation pressures. By maintaining a sufficiently high pressure on the material after excavation, the gas bubbles can be maintained in the matrix. Typically, this pressure is from about 2 to about 20 bars. Releasing the trapped gas during hydrocycloning can reduce the output of carbon dioxide and methane emissions into the environment.

Although it is preferred to perform hydrocycloning in or at the machine to avoid some separation of bitumen during significant hydrotransportation, hydrocycloning is not required to occur in the underground mining machine immediately after excavation. In one process configuration, the first slurry is contacted with a solvent such as water to form a third slurry having a third slurry density that is lower than the first slurry density but higher than the second slurry density, and the third slurry is hydrotransported away from the mining machine. When the hydrocycloning extraction process is carried out at a location remote from the machine, the relative densities and percent solids content of the various slurries can be important, as in the first configuration, for reducing the requirements for makeup solvent; avoiding unnecessary de-watering steps; minimizing energy for transporting material; and minimizing energy for extracting the valuable hydrocarbons. The third slurry has a preferred density ranging from about 1,350 to about 1,650 kilograms per cubic meter. At a location remote from the machine, the third slurry is diluted with solvent to form the second slurry which has sufficient water content for hydrocycloning. After hydrocycloning, the second output or tails may be transported back into the excavation for backfilling by any technique, such as conveyor or rail.

The first embodiment can offer other advantages over conventional excavation systems. Hydrocycloning underground can separate most of the hydrocarbons in the excavated material in or near the mining machine and produce a hydrocarbon-containing slurry for hydrotransport to the surface. Due to the efficiency of hydrocyclone separation, a high percentage of the water can be reused in the hydrocyclone, thereby reducing the need to transport fresh water into the underground excavation. The use of slurry mining techniques can condition properly the hydrocarbon-containing material for further processing underground, such as comminution and hydrocycloning. The combination of both underground mining and hydrocycloning can reduce materials handling by a factor of approximately two over the more efficient surface mining methods because there is no need for massive overburden removal.

In a second embodiment, a method for selective underground mining is provided that includes the steps of:

(a) excavating a material with a plurality of excavating devices, each excavating device being in communication with a separate input for the excavated material;

(b) directing first and second streams of the excavated material into first and second inputs corresponding to first and second excavating devices;

(c) determining (before or after excavation of the material) a value (e.g., a grade, valuable mineral content, etc.) of each of the first and second streams;

(d) when a first value of the first stream is significant (e.g., above a predetermined or selected level or threshold), directing the first stream from the first input to a first location (e.g., a valuable mineral extraction facility, a processing facility and the like);

(e) when a first value of the first stream is not significant (e.g., below a predetermined or selected level or threshold), directing the first stream from the first input to a second location (e.g., a waste storage facility, a second processing or mineral extraction facility for lower grade materials, and the like);

(f) when a second value of the second stream is significant, directing the second stream from the second input to the first location; and (g) when a second value of the second stream is not significant, directing the second stream from the second input to the second location.

The above method for selective underground mining allows the quality or grade of the ore stream to be maintained within predetermined limits. These predetermined limits may be set to provide an ore feed that is suitable for hydrocycloning which is known to operate efficiently for ore grades that are above a certain limit.

By way of illustration, if it is determined, at a first time, that the first stream has a significant value, the first stream is directed to the first location and, if it is determined, at a second later time, that the first stream does not have a significant value, the first stream is directed to the second location. In this manner, the various streams may be switched back and forth between the first and second locations to reflect irregularities in the deposit and consequent changes in the value of the various streams. This can provide a higher value product stream with substantially lower rates of dilution.

The grade of the excavated material can be determined by any number of known techniques. For example, the grade may be determined by eyesight, infrared techniques (such as Near Infra Red technology), core drilling coupled with a three-dimensional representation of the deposit coupled with the current location of the machine, induction techniques, resistivity techniques, acoustic techniques, density techniques, neutron and nuclear magnetic resonance techniques, and optical sensing techniques. The grade is preferably determined by the use of a sensor positioned to measure grade as the excavated material flows past. The ore grade accuracy preferably has a resolution of less than about 1% and even more preferably less than about 0.5% by mass of the bitumen in the excavated material.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION OF THE DRAWINGS

Figure 1:
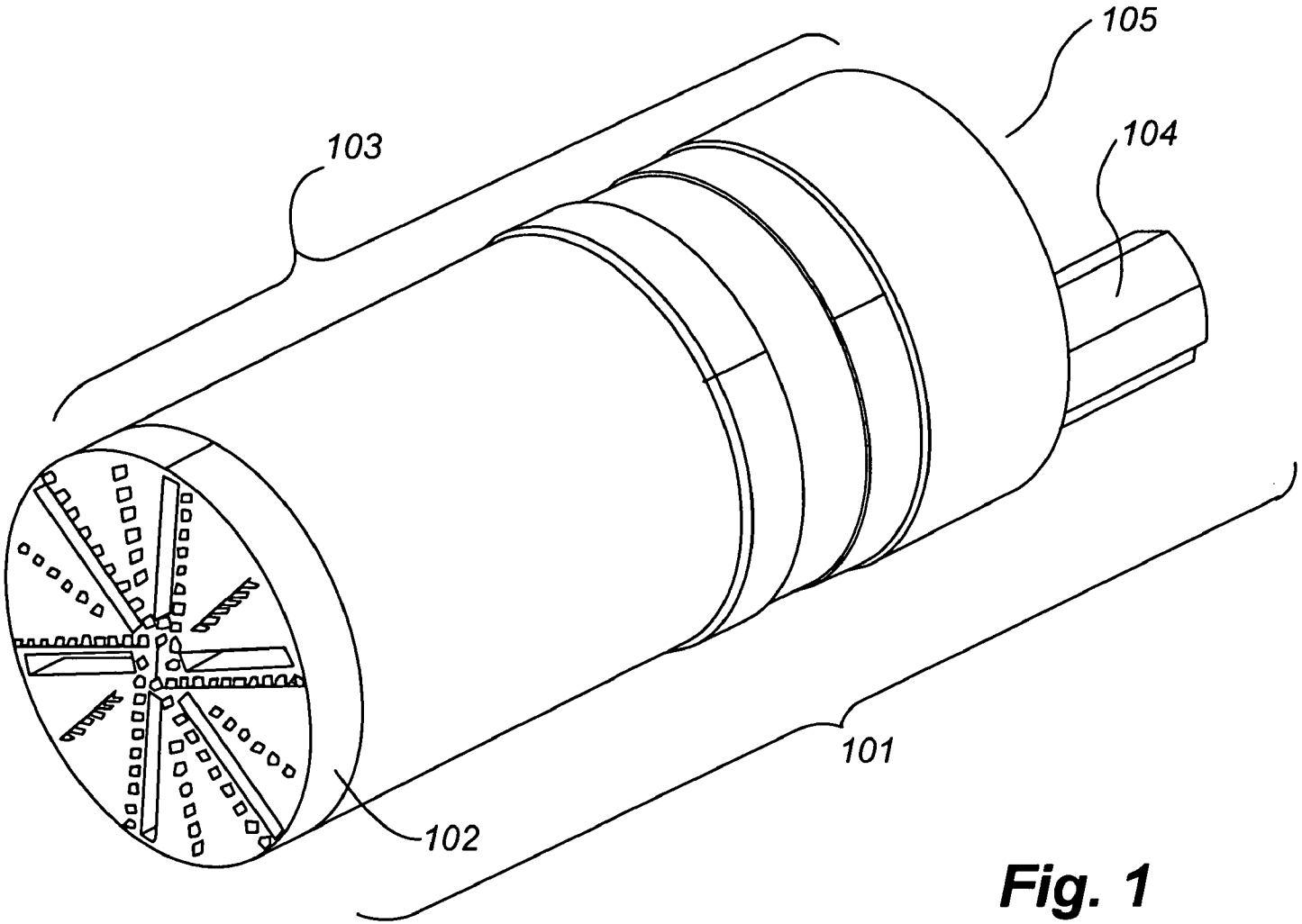
Fig. 1 (Prior Art)
FIG. 1 shows an isometric schematic view of a fully shielded backfilling mining machine as embodied in U.S. Pat. No. 6,554,368.

FIG. 1 which is prior art shows an isometric schematic view of a fully shielded backfilling mining machine 101 as embodied in U.S. Pat. No. 6,554,368. The principal elements of this figure are the excavation or cutter head 102 (shown here as a typical TBM cutting head); the body of the mining machine 103 which is composed of one or more shields; and the trailing access tunnel 104 which is formed inside the body of the machine 101 and left in place as the machine 101 advances. The backfill material is emplaced behind the body of the mining machine 101 and around the access tunnel 104 in the region 105 to fully fill the excavated volume not occupied by the machine 101 or the access tunnel 104. This figure is more fully discussed in U.S. Pat. No. 6,554,368 (FIG. 3) which is incorporated by reference herein.

Figure 2:
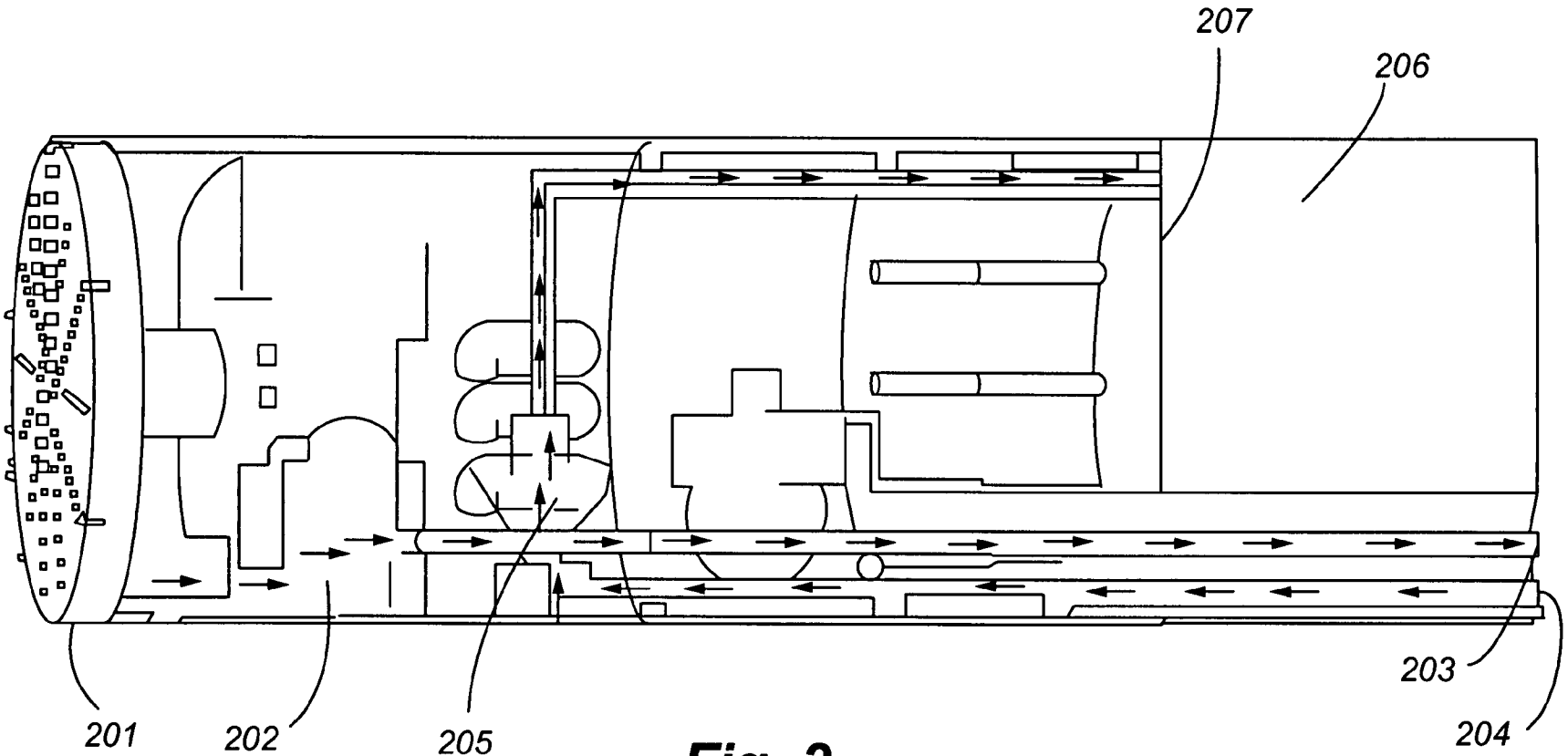
Fig. 2 (Prior Art)
FIG. 2 shows a cutaway side view of the principal internal components of a fully shielded backfilling mining machine with no internal ore separation apparatus as embodied in U.S. Pat. No. 6,554,368.

FIG. 2 which is prior art shows a cutaway side view of the principal internal components of a fully shielded backfilling mining machine with no internal ore separation apparatus as embodied in U.S. Pat. No. 6,554,368. The ore is excavated by an excavating mechanism 201 (here shown as a TBM cutter head). The ore is then processed as required by a crusher/slurry apparatus 202 to form a slurry for hydrotransport. The ore slurry is removed from the machine to the surface by a hydrotransport pipeline 203. On the surface, the ore is separated into a bitumen product stream and a waste stream of tails. Tailings used for backfill are returned to the machine by a tailings slurry pipeline 204. The tailings slurry is de-watered in an apparatus 205 and emplaced behind the machine in the volume 206. In this embodiment, the machine is propelled forward by a thrust plate 207 which thrusts off the backfill further compressing the backfill.

Figure 3:
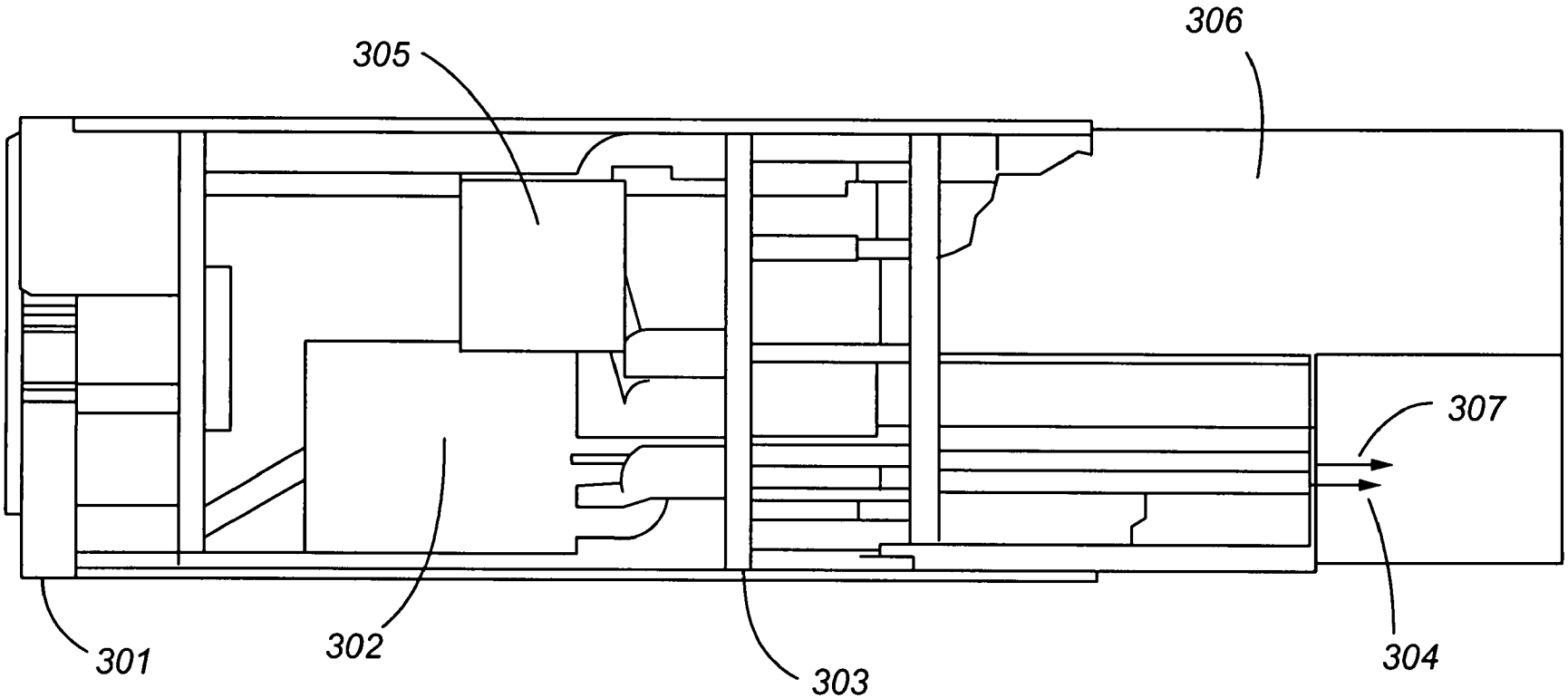
FIG. 3 shows a cutaway side view of the principal internal components of a fully shielded backfilling mining machine with internal ore separation apparatus as embodied in U.S. Pat. No. 6,554,368.

FIG. 3 which is prior art shows a cutaway side view of the principal internal components of a fully shielded backfilling mining machine with internal ore separation apparatus as embodied in U.S. Pat. No. 6,554,368. The ore is excavated by an excavating mechanism 301 (here shown as a TBM cutter head). The ore is then processed as required by an extraction system 302, which may include a crusher, to form a bitumen product stream and a waste stream of tails. The excavating mechanism 301 and the extraction system 302 may be separated from the rear of the machine by a pressure bulkhead 303 so that the excavating step and extraction step may be carried out at formation pressure. The bitumen product stream is removed from the machine to the surface by a pipeline 304. A portion of the waste stream of tails is sent directly to an apparatus 305 which places the backfill material in the volume 306. Because the oil sands tails typically bulk up even after removal of the bitumen, some of the tailings are transported to the surface by a tailings slurry pipeline 307. In the event that barren ground or low grade ore is encountered, all of the excavated material may be shunted directly to the backfill apparatus 305 and the excess tails pipeline 307 without going through the extraction apparatus 302. This figure is more fully discussed in U.S. Pat. No. 6,554,368 (FIG. 5) which is incorporated by reference herein.

Figure 4:
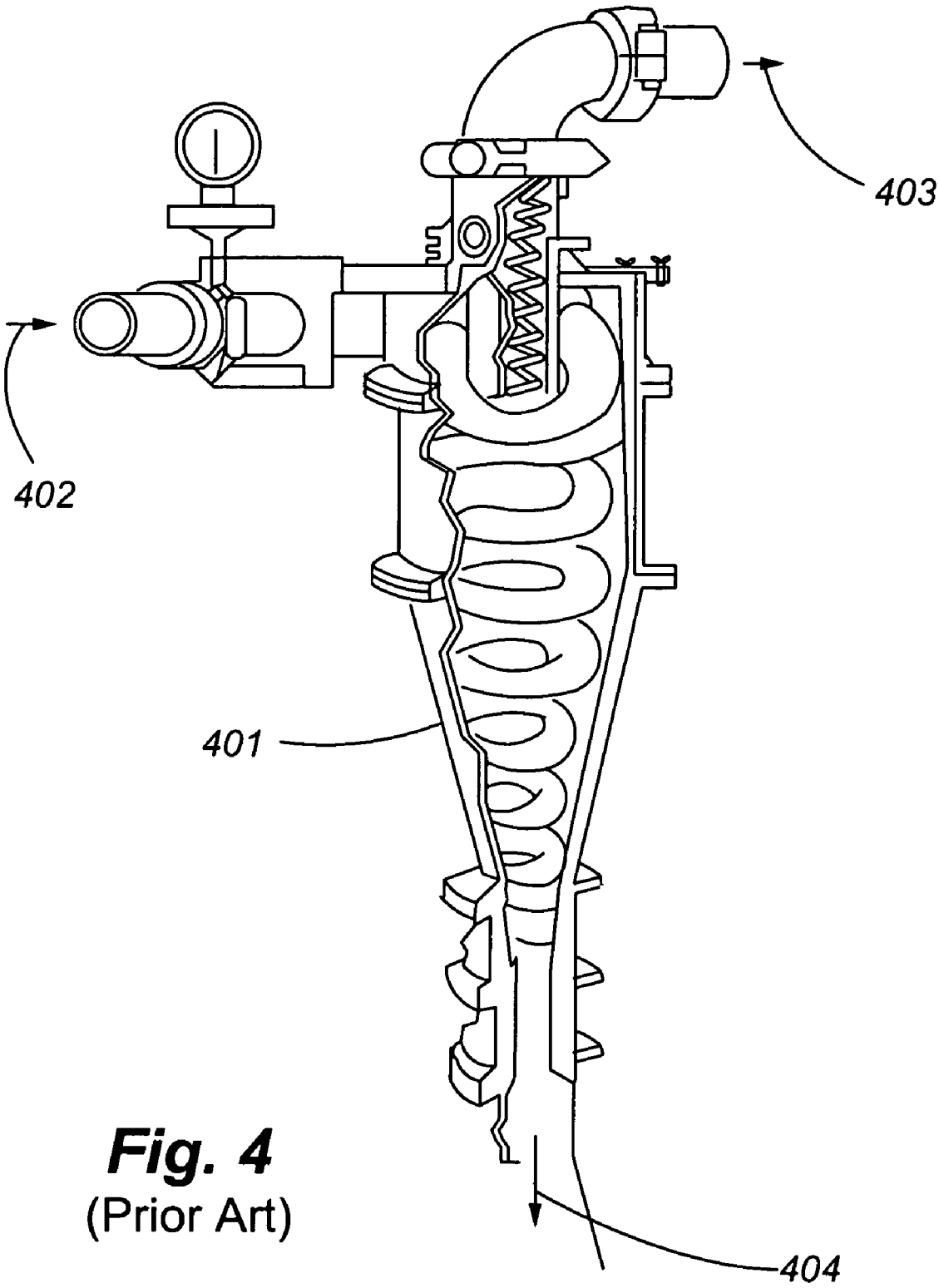
Fig. 4 (Prior Art)
FIG. 4 shows a cutaway side view of a typical hydrocyclone apparatus.

FIG. 4 which is prior art shows a cutaway side view of a typical hydrocyclone apparatus 401. As applied to oil sands, the input feed 402 typically consists of high density solids (primarily quartz sand with a small portion of clay and shale fines) and low density product (water and bitumen or heavy oil). The cyclonic action of the hydrocyclone 401 causes the high density solids to migrate downwards along the inside surface of the hydrocyclone 401 by centrifugal forces and be ejected from the bottom port 404 commonly called the underflow. The low density product migrates to the center of the hydrocyclone 401 and is collected in the center of the hydrocyclone 401 and removed via the top port 403 commonly called the overflow. In a typical oil sands application, the overflow is comprised approximately of 12% of the feed stocks high density solids and 70% of the feed stocks low density product. The underflow is reversed comprised approximately of 88% of the feed stocks high density solids and 30% of the feed stocks low density product. While this degree of separation is good, the underflow can be used as feed stock for a subsequent hydrocyclone with the same degree of separation. Thus one hydrocyclone separates 70% of the total input bitumen/water product, a second hydrocyclone increases the overall separation to 91% and a third hydrocyclone to over 97%. This is further illustrated in the mass flow rate balances shown for example in FIG. 11 and Table 1 wherein a processor comprised of three hydrocyclones is employed. Hydrocyclones are well-known devices and other modified versions are included in the present invention. For example, air-sparging hydrocyclones may have value because they air can be forced into the interior of the cyclone body 401 to, among other advantages, assist in carrying hydrophobic particles (such as bitumen) to the overflow. This function may also be accomplished by methane and carbon dioxide bubbles released by the oil sands when the pressure is reduced below natural formation pressure.

Figure 5:
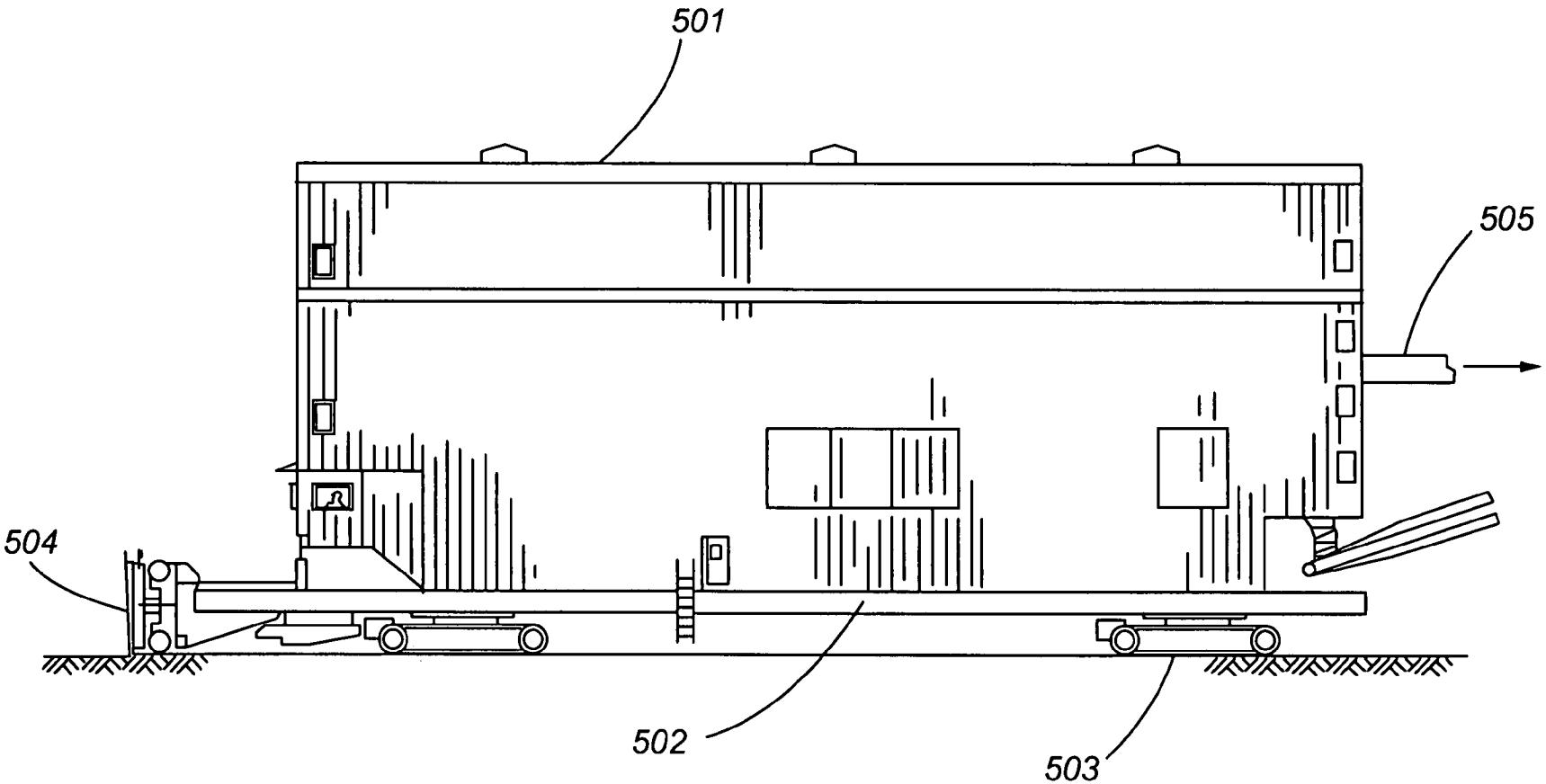
Fig. 5 (Prior Art)
FIG. 5 shows a schematic side view of a mobile surface mining machine as embodied in Canadian 2,332,207.

FIG. 5 which is prior art shows a schematic side view of a mobile surface mining machine as embodied in Canadian 2,332,207. A housing 501 contains most of the hydrocyclone and associated ore processing apparatus. The housing is mounted on a frame 502 which contains the means of propulsion such as, for example, crawler tracks 503. An apparatus 504 that excavates the exposed oil sands is mounted on the front of frame 502. A dirty bitumen froth is output from the rear of the housing 501 via a pipeline 505 for transport to a froth treatment facility (not shown). The tails are discharged via a conveyor 506 for disposal either in a tailings disposal area or directly on the ground behind the advancing surface mining machine.

Figure 6:
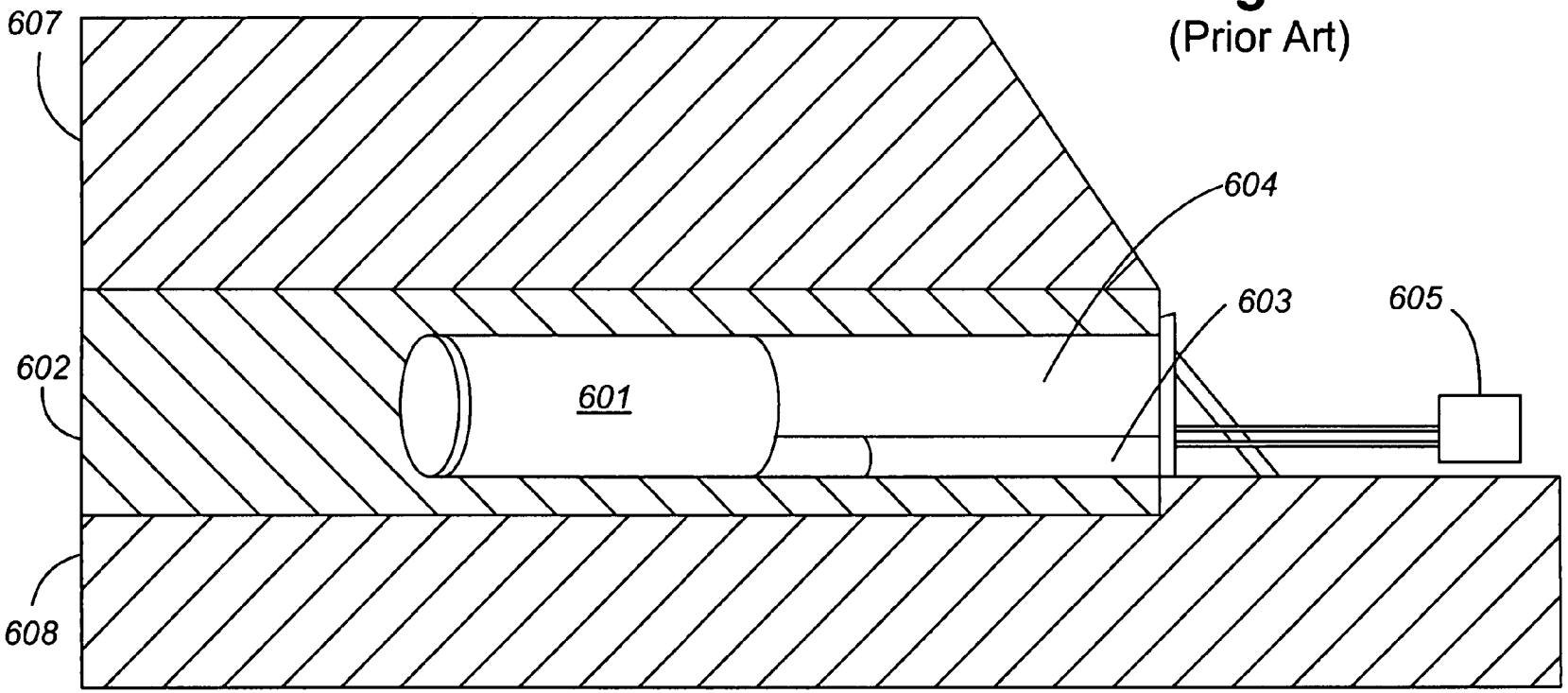
Fig. 6 (Prior Art)
FIG. 6 shows a cutaway side view of the basic mining process as embodied in U.S. Pat. No. 6,554,368.

FIG. 6 which is prior art shows a cutaway side view of the basic mining process as embodied in U.S. Pat. No. 6,554,368. This soft-ground underground mining method is based on a fully shielded mining machine 601 that excavates ore 602 in a deposit underlying an amount of overburden 607 and overlying a barren basement rock 608; forms a fixed trailing access tunnel 603 and backfills the volume 604 behind the machine 601 with tails from the processed ore. The ore 602 may be transported to a surface extraction facility 605 for external processing or the ore 602 may processed inside the machine 601. This underground mining process is more fully discussed in FIGS. 1 and 2 of U.S. Pat. No. 6,554,368 which is incorporated by reference herein.

Figure 7:
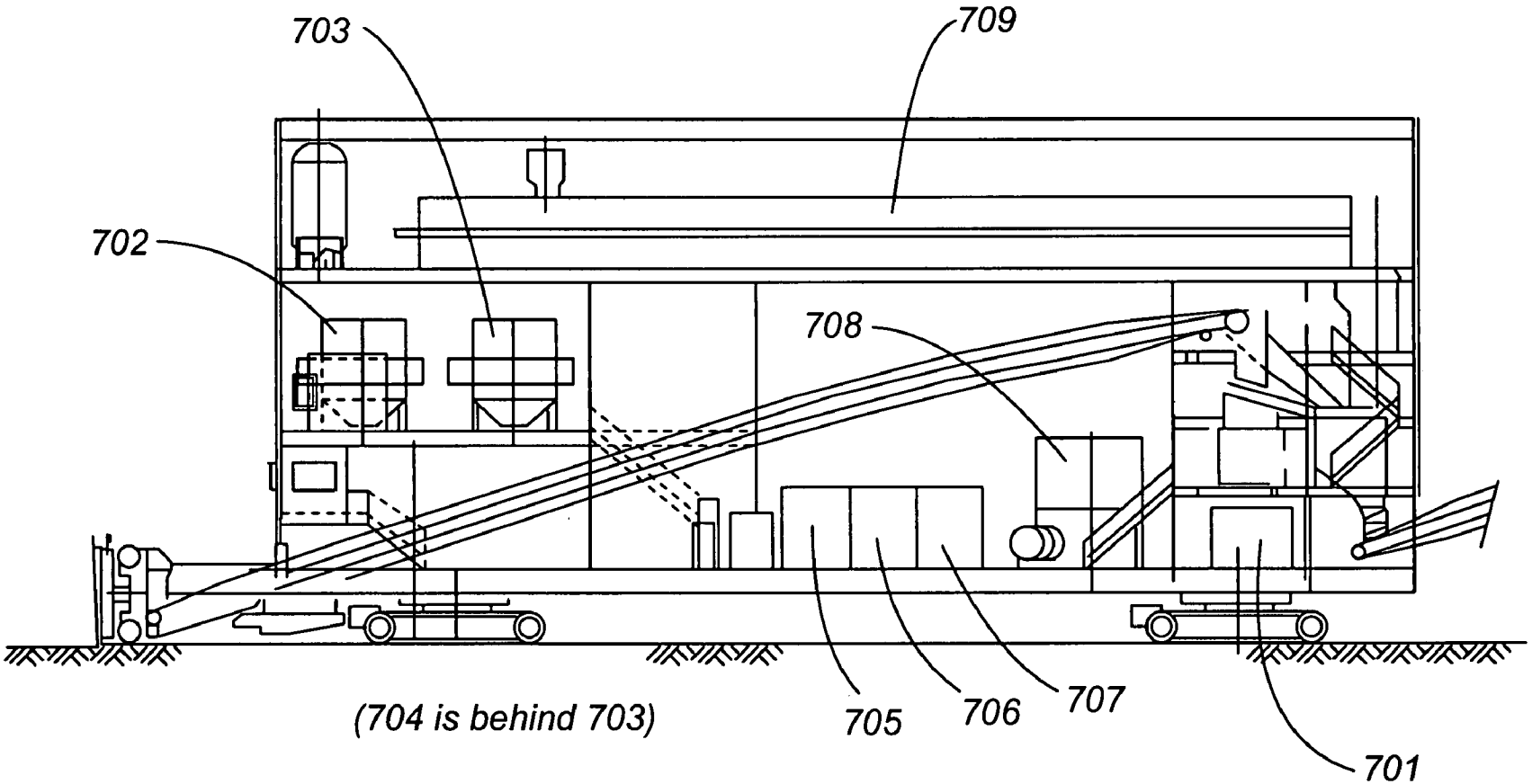
Fig. 7 (Prior Art)
FIG. 7 shows a cutaway side view of a mobile surface mining machine as embodied in Canadian 2,332,207.

FIG. 7 which is prior art shows a cutaway side view of a mobile surface mining machine as embodied in Canadian 2,332,207. This figure illustrates a conceptual layout of the various components that could form one of a number of configurations of a hydrocyclone-based bitumen extraction system. For example, a slurry mixing tank 701; hydrocyclones 702, 703 and 704; sump tanks 705, 706 and 707; decanter 708; and vacuum filter system 709 are shown. These elements are described in more detail in the detailed description of FIG. 8.

In the following descriptions, a slurry is defined as being comprised of bitumen, solvent and solids. The bitumen may also be heavy oil. The solvent is typically water. The solids are typically comprised of principally sand with lesser amounts of clay, shale and other naturally occurring minerals. The percentage solids content by mass of a slurry is defined as the ratio of the weight of solids to the total weight of a volume of slurry. The bitumen is not included as a solid since it may be at least partially fluid at the higher temperatures used at various stages of the mining, transporting and extraction processes.

Figure 8:
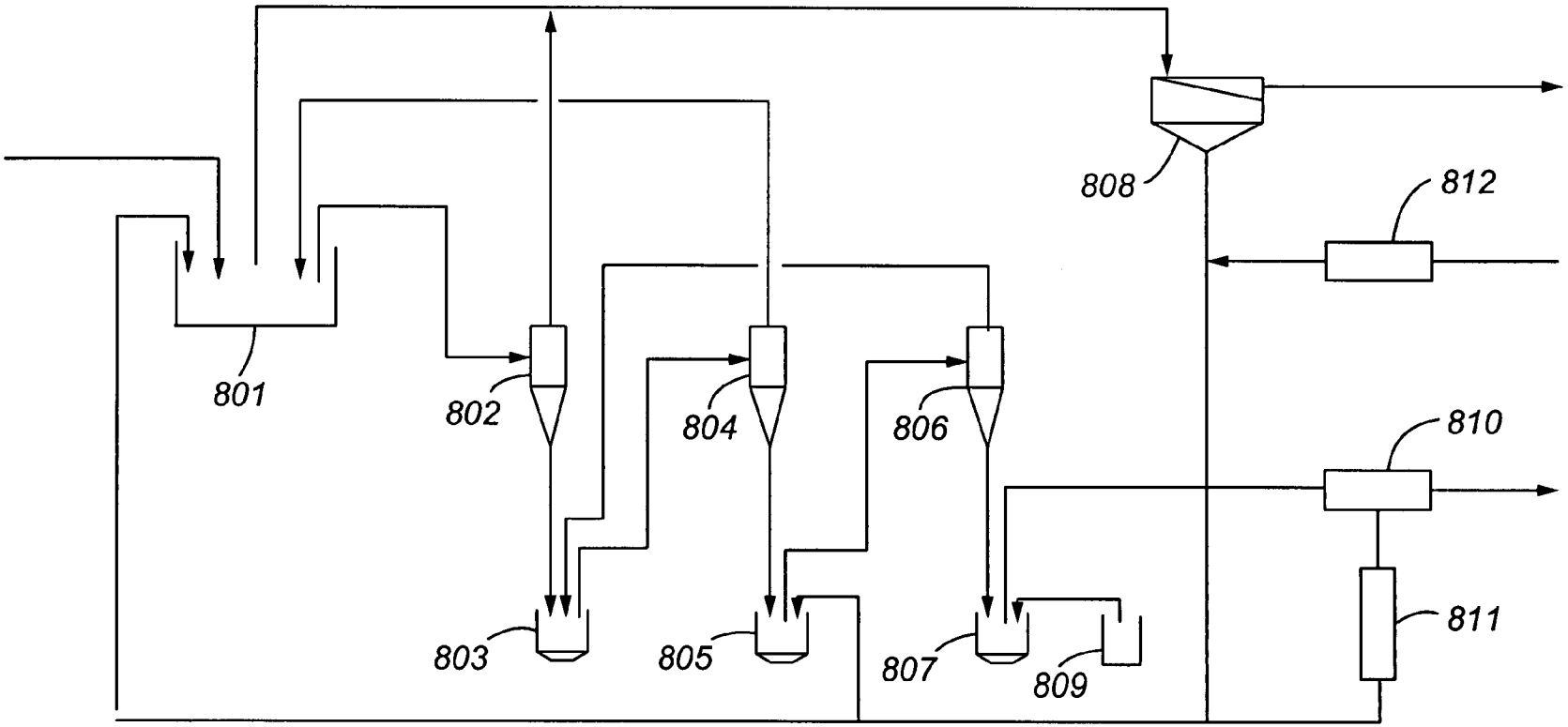
Fig. 8 (Prior Art)
FIG. 8 shows flow chart of the elements of a hydrocyclone-based bitumen extraction unit as embodied in Canadian 2,332,207.

FIG. 8 which is prior art shows flow chart of the elements of a hydrocyclone-based bitumen extraction unit as embodied in Canadian 2,332,207. An oil sands ore is input into a slurry mixing tank 801 where the slurry composition is maintained at about 50% by mass solids (primarily quartz sand with a small portion of clay and shale fines). Some of the bitumen and water (together called a bitumen froth) is skimmed off and sent to a decanter 808. The remaining slurry is pumped to the input feed of a first hydrocyclone 802. The overflow from the first hydrocyclone 802 is sent directly to the decanter 808. The underflow of the first hydrocyclone 802 is discharged to a first sump pump 803. The material from the first sump 803, which also includes the overflow from a third hydrocyclone 806, is pumped to the input feed of a second hydrocyclone 804. The overflow from the second hydrocyclone 804 is sent back to the slurry mixing tank 801. The underflow of the second hydrocyclone 804 is discharged to a second sump pump 805. The material from the second sump 805, which also includes the addition of water from elsewhere in the system, is pumped to the input feed of the third hydrocyclone 806. The overflow from the third hydrocyclone 806 is pumped back into the first sump 803. The underflow of the third hydrocyclone 806 is discharged to the third sump pump 807. The material from the third sump 807, which also includes the addition of a flocculent from a flocculent tank 809, is pumped to a vacuum filter system 810. The decanter 808 provides a product stream comprised of a bitumen enriched froth and a recycled water stream which is returned to the slurry tank 801 and a portion to the second sump 807. The vacuum filter 810 recovers water from its input feed and discharges this water to an air-liquid separator 811 which, in turn, adds the de-aerated water to the supply of water from the decanter 808 and the make-up water 812. These three sources of water are then fed to the slurry tank 801 with a portion being sent to the second sump 807. The vacuum filter 810 has as its main output a de-watered material which is waste or tails. This is an example of a number of possible configurations for a multiple hydrocyclone-based bitumen extraction unit. The principal advantage of this type of bitumen extraction unit is that the input feed is an oil sands ore slurry to which water must be added; a bitumen froth product output stream that is suitable for a conventional froth treatment facility, and a waste or tails output that is suitable for use as a backfill material, without further de-watering, for a backfilling mining machine such as described in U.S. Pat. No. 6,554,368.

The present invention takes advantage of the requirements of the hydrocyclone ore processing method and apparatus to create an underground mining method whereby the ore may be processed inside the mining machine; between the mining machine and portal to the underground mine operation or, at the portal. The latter option makes use of the known properties of oil sands hydrotransport systems which requires an oil sands ore slurry compatible with both the mining machine excavation output slurry and the hydrocyclone input slurry. A further advantage of the present invention is that the waste output from the hydrocyclone processing step may be fully compatible with the back-filling requirements of the shielded underground mining machine. The only apparatus that includes a de-watering function is typically the hydrocyclone ore extraction apparatus. Most of the water used in the various stages is typically recovered. A relatively small amount may be lost in the slurry excavation process, the bitumen product stream and in the tails.

Another aspect of the present invention is to excavate and process the ore at formation pressure so as to retain the methane and other gases in the oil sands ore for the processing step of extraction. This is because gases are present as bubbles attached to the bitumen and the bubbles can assist in the extraction process.

Another aspect of the present invention is to reduce materials handling by a factor of approximately two over the most efficient surface mining methods such as for example that described in Canadian 2,332,207 because, in an underground mining operation, much less overburden is removed, stored and replaced during reclamation.

In the embodiments of the present invention described below, it is envisioned that the mining machine will eventually operate in formation pressures as high as 20 bars. Further, the slurry may be formed using warm or hot water. The temperature of the hot water in the slurry in front of the of the cutter is preferably in the range of 10° C. to 90° C. The maximum typical dimension of the fragments resulting from the excavation process in front of the of the cutter is preferably in the range of 0.02 to 0.5 meters. The excavated material in slurry form is passed through a crusher to reduce the fragment size to the range required by the hydrocyclone processor unit and, in a second embodiment, by the hydrotransport system.

Internal Processing Embodiment

In one embodiment of the present invention, oil sands deposits are excavated by a slurry method where the density of the cutting slurry may be in the range of approximately 1,100 kg/cu m to 1,800 kg/cu m which, in oil sands corresponds to a range of approximately 20% to 70% solids by mass. The choice of cutting slurry density is dictated by the ground conditions and machine cutter head design. In oil sands, it is typically more preferable to utilize a cutting slurry at the higher end of the slurry density range. The cutting slurry density may be selected without regard for the requirements of the hydrocyclone processing step because the hydrocyclone processor requires a slurry feed in the range of approximately 1,400 kg/cu m to 1,600 kg/cu m which typically below the density range of the preferred cutting slurry and can always be formed by adding water to the excavated slurry.

The excavated material may be processed internally in the excavating machine by a hydrocyclone based processor unit. The principal elements of the processor system include a slurry mixing tank, one or more hydrocyclones, sump pumps, a decanter, a de-watering apparatus and various other valves, pumps and similar apparatuses that are required for hydrocyclone processing.

The processor unit requires a slurry mixture that is typically in the range of approximately 30% to 50% solids by mass and more typically is approximately 40% where the principal slurry components are typically taken to be water, bitumen and solids. It is noted that the slurry mixture in the slurry tank of the hydrocyclone processor is different than the slurry feed. The slurry mixture in the slurry tank includes the slurry feed and the overflow from one of the hydrocyclones.

A typical hydrocyclone unit will produce an overflow that contains about 70% of the water and bitumen from the input feed and about 10 to 15% of the solids from the input feed. Thus the hydrocyclone is the principal device for separating bitumen and water (densities of approximately 1,000 kg/cu m) from the solids (densities in the range of 2,000 to 2,700 kg/cu m). By adding additional hydrocyclones, the overflow of each subsequent hydrocyclone may be further enriched in bitumen and water by successively reducing the proportion of solids. Water may be removed from the bitumen product stream by utilizing, for example, a decanter apparatus or other water-bitumen separation device known to those in the art. Water may be removed from the waste stream by utilizing, for example, a vacuum air filtration apparatus or other de-watering device known to those in the art.

As an example, the output bitumen product stream is ready for further bitumen froth treatment. The waste stream is in the range of about 12 to 15% water by mass and so is ideal and ready for use a backfill material by the backfilling mining machine.

Therefore the combination of a backfilling machine that excavates in slurry mode is well-matched to providing a suitable feed slurry to a processing unit based on one or more hydrocyclones. This is because the output of the excavation always requires some crushing of the solids and some addition of some water to the hydrocyclone processor feed. Both of these operations are straightforward. (For example, it is not straightforward to de-water a slurry for the input feed of the ore processor apparatus.) Further, the waste output of the hydrocyclone processor is a substantially de-watered sand which is ideal for backfill of the fully shielded mining machine such as described in U.S. Pat. No. 6,554,368.

In the above embodiment, the ore extraction processing step is carried out inside the backfilling fully-shielded mining machine. This configuration has the advantage of minimizing the movement of waste material from the excavation face and of achieving a large reduction in energy consumption. It is noted that, in this configuration, not all the waste can be emplaced as backfill because of the volume taken up by the trailing access tunnel and because of bulking of the sand which forms the major portion of the waste. Nevertheless, most of the waste (typically 70% or more by mass) can be directly emplaced as backfill.

Figure 9:
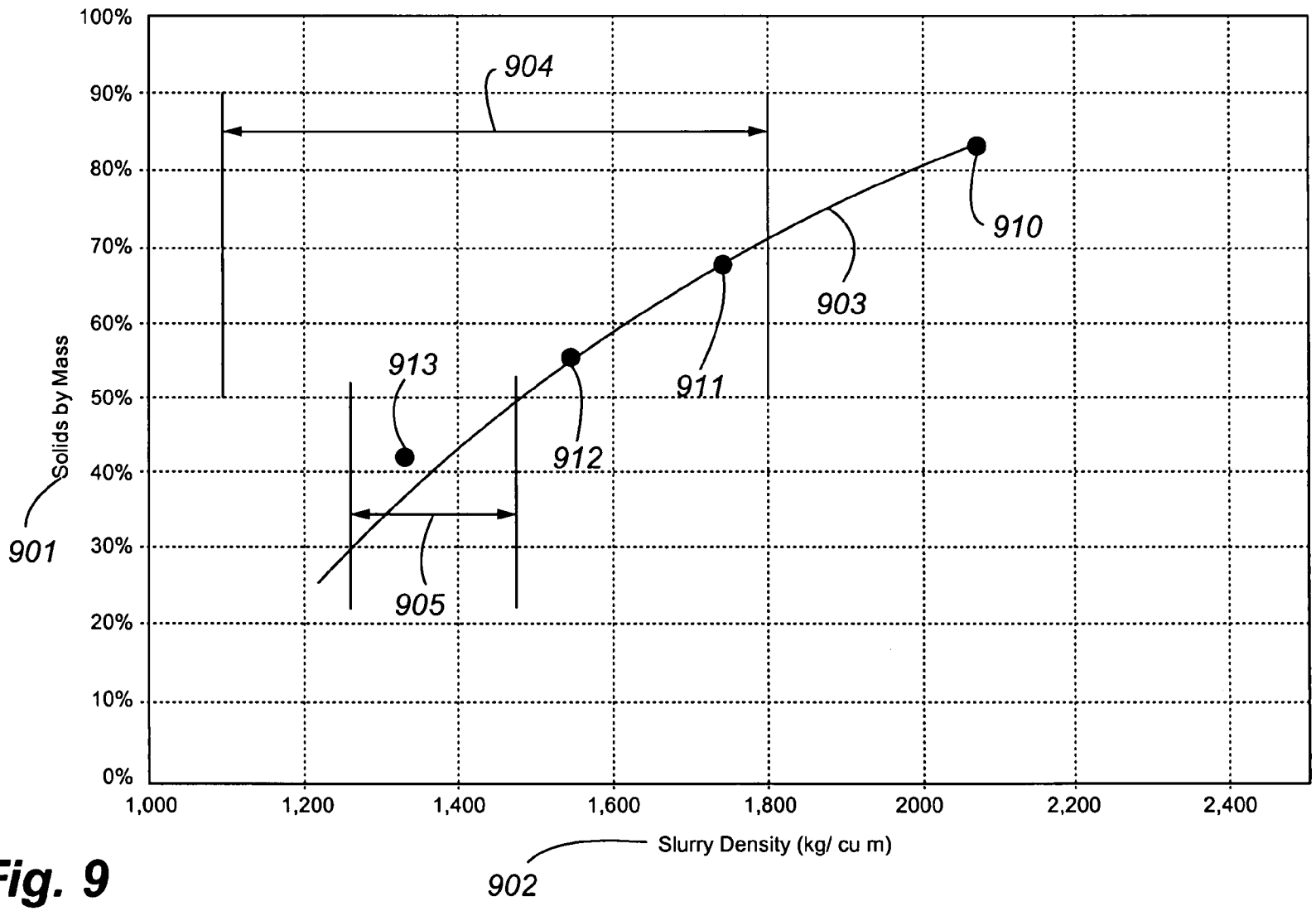
FIG. 9 shows a graph of the solids content by mass versus the density of a typical oil sands slurry illustrating a cutting slurry and a processing slurry.

FIG. 9 shows a graph of the solids content by mass 901 on the Y-axis versus the density of an oil sands slurry 902 on the X-axis. The slurry density curve 903 is for a typical oil sands ore (11% bitumen by mass, in-situ density of 2,082 kg per cu m, 35% porosity with 3% shale dilution). Slurry density decreases with addition of water which reduces the percentage of solids content. The practical range 904 of cutting slurries for a slurry TBM or hydraulic mining machine is approximately between 1,100 kg per cu m and 1,800 kg per cu m, although wetter and drier slurries are within the state-of-the-art. The optimum range of oil sands slurry mix tank densities 905 for a hydrocyclone-based ore processor is shown as ranging from approximately 33% to about 50% solids by mass corresponding to a slurry density range of about 1,250 to approximately 1,500 kg per cu m. Thus, there is a substantial range of excavation slurries that can be used that are higher in density than required by the feed for a hydrocyclone-based processor. The ore can be excavated hydraulically or by slurry means and always require addition of water to form the feed for the processor. A de-watering of the excavated ore slurry is not required. The average composition of the mixture in the slurry feed tank discussed in FIG. 11 below is shown by location 913 on curve 903. The in-situ ore is shown as 910; the excavation cutting slurry as 911 and the slurry tank feedstock as 912. The mixture in the slurry tank 913 includes the slurry feedstock 912 as well as the overflow from one of the hydrocyclones. Since the overflow is richer in bitumen and water, the slurry mixture 913 is not on the oil sand slurry curve 903.

Figure 10:
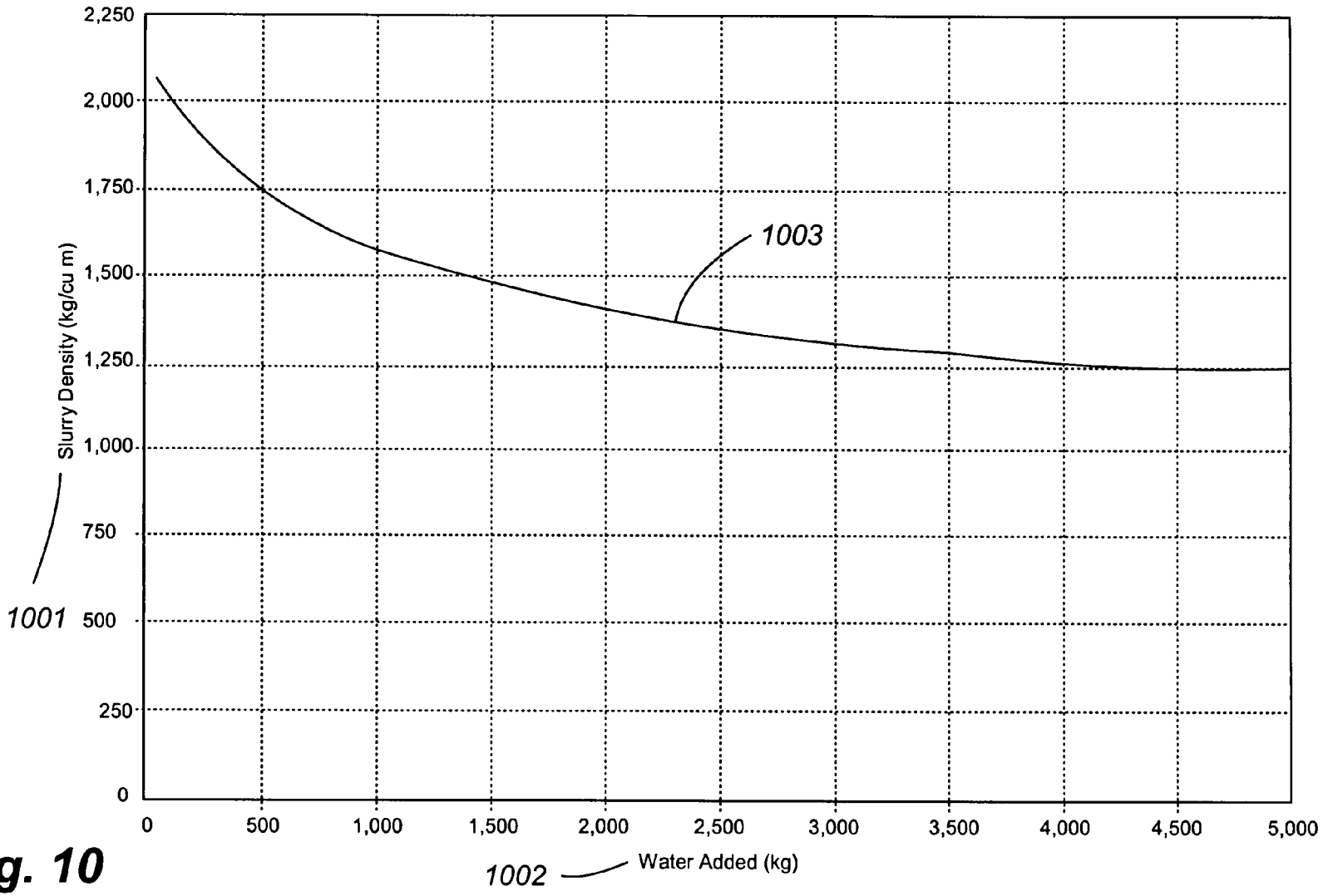
FIG. 10 shows a graph of the density of a typical oil sands slurry versus the amount of water required to achieve a given slurry density.

FIG. 10 shows a graph of the density 1001 of a typical oil sands slurry versus the amount of water 1002 required to achieve a given slurry density. The curve 1003 is based on the in-situ oil sands described above for FIG. 9. This curve shows that the density of an oil sands slurry is always lowered by the addition of water.

Figure 11:
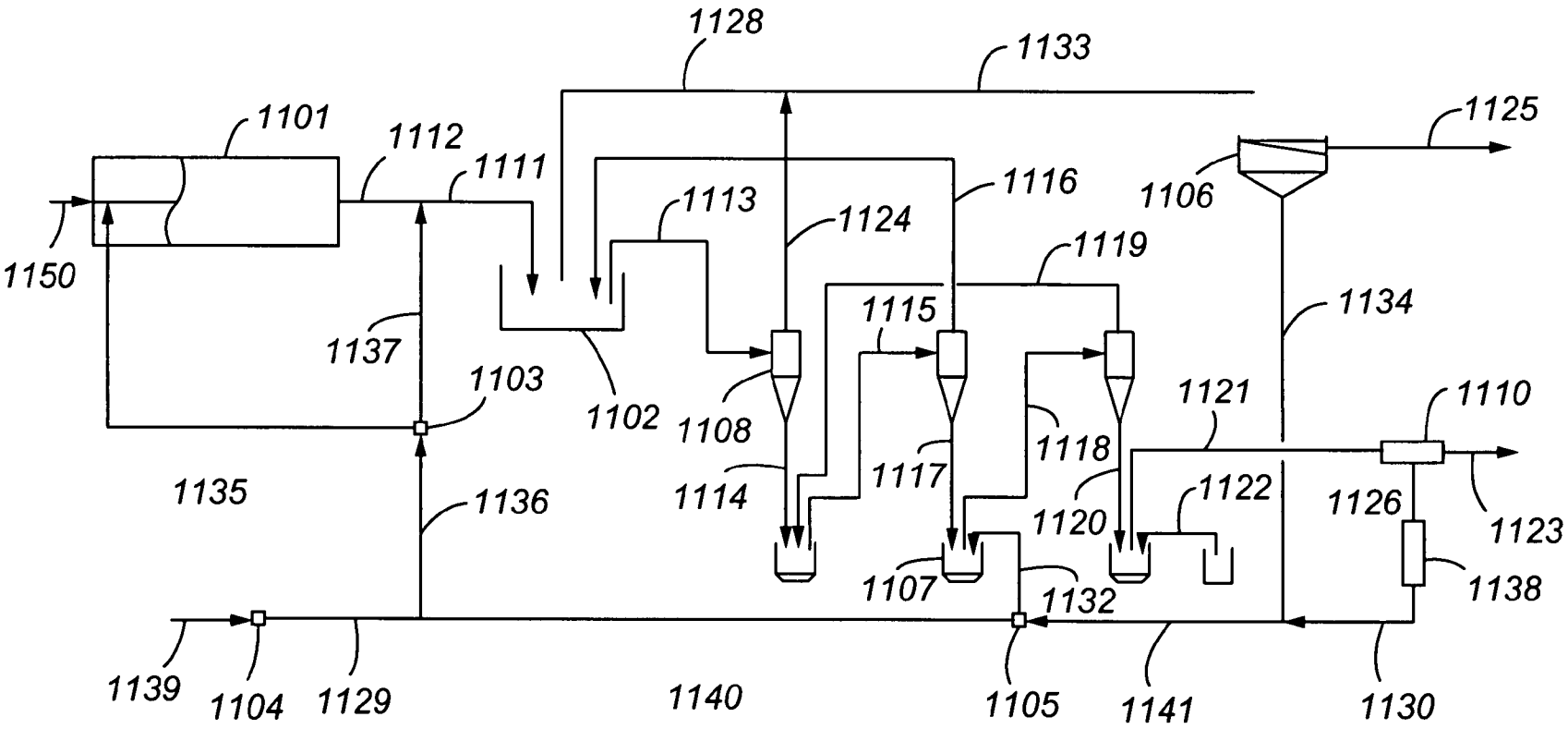
FIG. 11 shows flow chart of the elements of a hydrocyclone-based bitumen extraction unit as modified to accept the ore feed from a typical underground slurry excavating machine.

FIG. 11 shows flow chart of the elements of a hydrocyclone-based bitumen extraction unit as modified to accept the ore feed from a typical underground slurry excavating machine. The flow of material through the system is much like that outlined in the detailed description of FIG. 8. The principal difference is the locations in the process illustrated in FIG. 11 where water is added. An input supply of water 1139 allocates water to a first water distribution apparatus 1103. The first water distribution apparatus 1103 allocates water as required to a slurry mining machine 1101 to mix with the in-situ ore 1150 to form a cutting slurry 1112, and to a slurry mixing tank 1102 to form and maintain an approximately 33% to about 50% solids by mass slurry in the slurry tank 1102. A second water distribution apparatus 1105 controls the portion of water from a decanter 1106 that is, in part, added to a second sump 1107 and, in part, is returned to the first water distribution apparatus 1103. The mass flow rate balance (expressed as metric tonnes per hour) for FIG. 11 is presented below in Table 1. At steady state operating conditions, the input minus the output of bitumen, water and solids must equal zero for each component of the system. Most of the solids end up in the waste or tails stream 1123 which, for the present invention is largely used as backfill material. Most of the bitumen ends up in the product stream 1125. Ideally water is conserved. However some water is carried away in the bitumen froth product stream and some water is lost in the tails. Some water enters the system in the form of connate water associated with the in-situ oil sands (typically about 100 kg connate water per cubic meter of in-situ ore in the present example). Some water is lost to the formation around the cutter head of the mining machine, in the bitumen froth product stream and in the tails. Therefore, there is almost always a net input of water required. This is input via the input water supply 1139 which is externally obtained to make up for the net loss of water in the system. There is also a small input of water from the flocculent that may be added via stream 1122.

TABLE 1

| | Stream | | | | | |
|---|---|---|---|---|---|---|
| Tonnes per hour | 1111 Ore Feed to Slurry Tank | 1112 Slurry from TBM | 1113 Feed to 1st HydroCyc | 1114 Underflow from 1st HydroCyc | 1115 Feed to 2nd HydroCyc | 1116 Overflow from 2nd HydroCyc |
| Bitumen | 241 | 240 | 124 | 37 | 49 | 34 |
| Water | 985 | 600 | 2,228 | 669 | 2,194 | 1,536 |
| Solids | 1,752 | 1,752 | 1,919 | 1,688 | 1,903 | 228 |
| Total | 2,978 | 2,592 | 4,271 | 2,394 | 4,146 | 1,798 |

| | Stream | | | | | |
|---|---|---|---|---|---|---|
| Tonnes per hour | 1117 Underflow from 2nd HydroCyc | 1118 Feed to 3rd HydroCyc | 1119 Overflow from 3rd HydroCyc | 1120 Underflow from 3rd HydroCyc | 1121 Discharge from 3rd Sump | 1122 Floccutant to 3rd Sump |
| Bitumen | 15 | 16 | 11 | 5 | 5 | 0 |
| Water | 658 | 2,179 | 1,525 | 654 | 656 | 2 |
| Solids | 1,675 | 1,882 | 215 | 1,667 | 1,687 | 0 |
| Total | 2,348 | 4,077 | 1,751 | 2,326 | 2,328 | 2 |

| | Stream | | | | | |
|---|---|---|---|---|---|---|
| Tonnes per hour | 1123 Tailings Waste | 1124 Overflow from 1st HydroCyc | 1125 Product from Decanter | 1126 Water from Vacuum Filter | 1127 | 1128 Froth Skimmed from Slurry Tank |
| Bitumen | 5 | 87 | 235 | 0 | | 151 |
| Water | 273 | 1,560 | 109 | 383 | | 293 |
| Solids | 1,667 | 230 | 83 | 0 | | 61 |
| Total | 1,945 | 1,877 | 427 | 383 | | 505 |

| | Stream | | | | | |
|---|---|---|---|---|---|---|
| Tonnes per hour | 1129 Makeup Water | 1130 Water from Separator | 1131 | 1132 Water to 2nd Sump | 1133 Input to Decanter | 1134 Water from Decanter |
| Bitumen | 0 | 0 | | 2 | 238 | 3 |
| Water | 279 | 383 | | 1,521 | 1,853 | 1,744 |

TABLE 1-continued

| | | | | | | |
|---|---|---|---|---|---|---|
| Solids | 0 | 0 | 207 | 291 | 207 |
| Total | 279 | 383 | 1,730 | 2,382 | 1,954 |

| | Stream | | | | | |
|---|---|---|---|---|---|---|
| Tonnes per hour | 1135 Water to TBM | 1136 Water to 1st Distributor | 1137 Water from 1st Distributor | 1138 | 1139 | 1140 Water from 2nd Distributor |
| Bitumen | 0.5 | 1 | 0.5 | | | 1 |
| Water | 500 | 385 | 385 | | | 606 |
| Solids | 0 | 0 | 0 | | | 0 |
| Total | 501 | 386 | 386 | | | 607 |

| | Stream | | |
|---|---|---|---|
| Tonnes per hour | 1141 Water from Decanter and Separator | 1148 Water to Cutting Slurry | 1150 In-situ Cre |
| Bitumen | 3 | 0.5 | 240 |
| Water | 2,127 | 500 | 100 |
| Solids | 207 | 0 | 1,752 |
| Total | 2,337 | 501 | 2,092 |

Table 1 is a mass flow rate balance, expressed in tonnes per hour (tph), for the mining system depicted in FIG. 11. The flow paths described for Table 1 are shown in FIG. 11. The amount of water sent to the mining machine cutter slurry and the amount of water added to the ore slurry may be varied to allow the cutting slurry to be optimized for the local ground conditions. In this example, 279 tph of make-up water is added via path 1129 to water recovered from the decanter 1106 and the tailings vacuum filter system 1110 to make available 885 tph of water for path 1136 that feeds the mining machine 1101 and the slurry tank 1102. The 279 tph of make-up water represents the amount of water that must be added to the system to make up for the principal water losses via the product stream 1125 (109 tph) and the tailings stream 1123 (273 tph). It is noted that there is some input of water to the system via the ore input 1150 in the form of connate water which is accounted for in path 1112 which includes both connate water and water added to form the cutting slurry. Table 1 shows 241 tph bitumen, 985 tph water and 1,752 tph solids (primarily quartz sand with some clay and shale) as feed to the slurry tank 1102. Approximately 151 tph of bitumen are skimmed from the slurry tank 1102 and sent to the decanter 1106. The overflow from the first hydrocyclone 1108 is also sent to the decanter 1106 so that the total bitumen input along path 1133 to the decanter 1106 is 238 tph. The net bitumen output from the decanter 1106 along path 1125 is 235 tph which represents a system recovery of 97.5% of the bitumen input to the system. The tailings output via path 1123 is comprised of 5 tph bitumen, 273 tph water and 1,667 tph solids waste. In this example, the tailings are 14% by mass water. About 5% or 85 tph of the input solids are sent out as contaminants in the bitumen the product stream 1125. In this example, the density of the cutting slurry 1112 is 1,715 kg per cu m, the density of the slurry feed 1111 to the slurry tank 1102 is 1,566 kg per cu m and the density of the slurry in the slurry tank 1102 after the overflow from the 2nd hydrocyclone is added is 1,335 kg per cu m. Also in this example, the advance rate of, for example, a 15-m diameter TBM mining machine is about 5.7 meters per hour to process approximately 2,092 tonnes per hour of in-situ ore.

Figure 12:
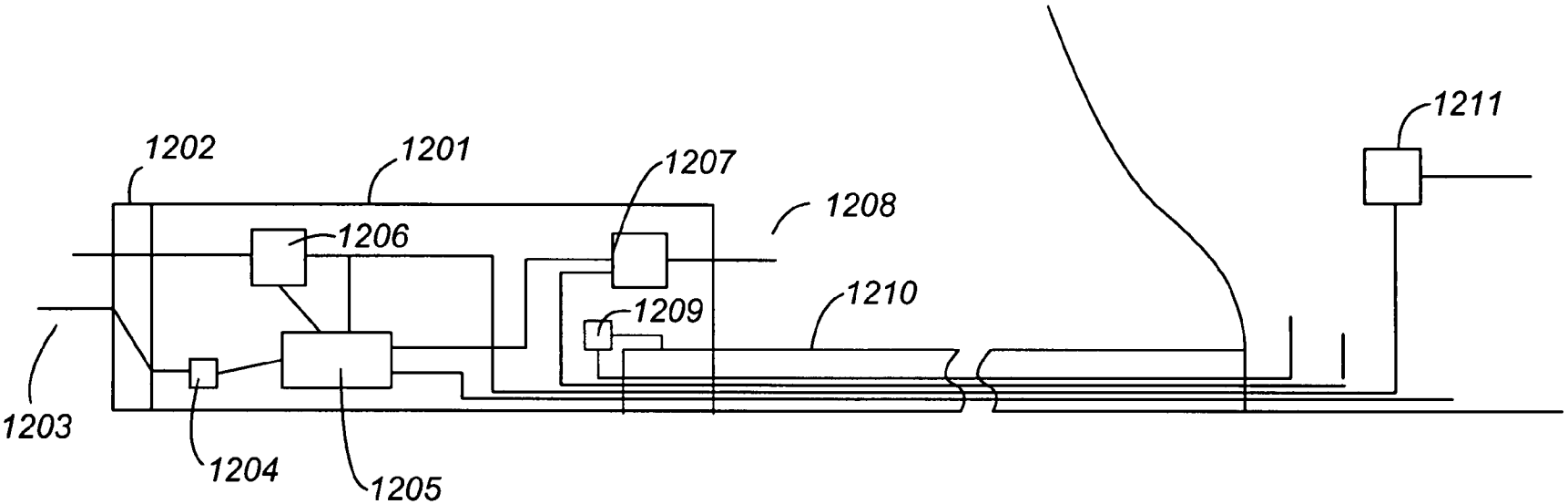
FIG. 12 schematically shows the basic components of a preferred embodiment of the present invention with ore processing in the mining machine.

FIG. 12 schematically shows the basic components of a preferred embodiment of the present invention with ore processing in the mining machine. The mining machine is enclosed in a shield 1201 and has an excavation head 1202 which excavates the ore 1203. The ore passes through the excavation or cutter head 1202 to a crusher 1204 and then to an ore extraction apparatus 1205. Water required by the process is input from a supply tank 1211 and is heated in the mining machine by a heat exchanger and distribution apparatus 1206. Backfill material 1208 is emplaced by a backfill apparatus 1207. The access tunnel liner 1210 is formed by, for example, a concrete mix, and is emplaced for example by a tunnel liner installation apparatus 1209.

Figure 13:
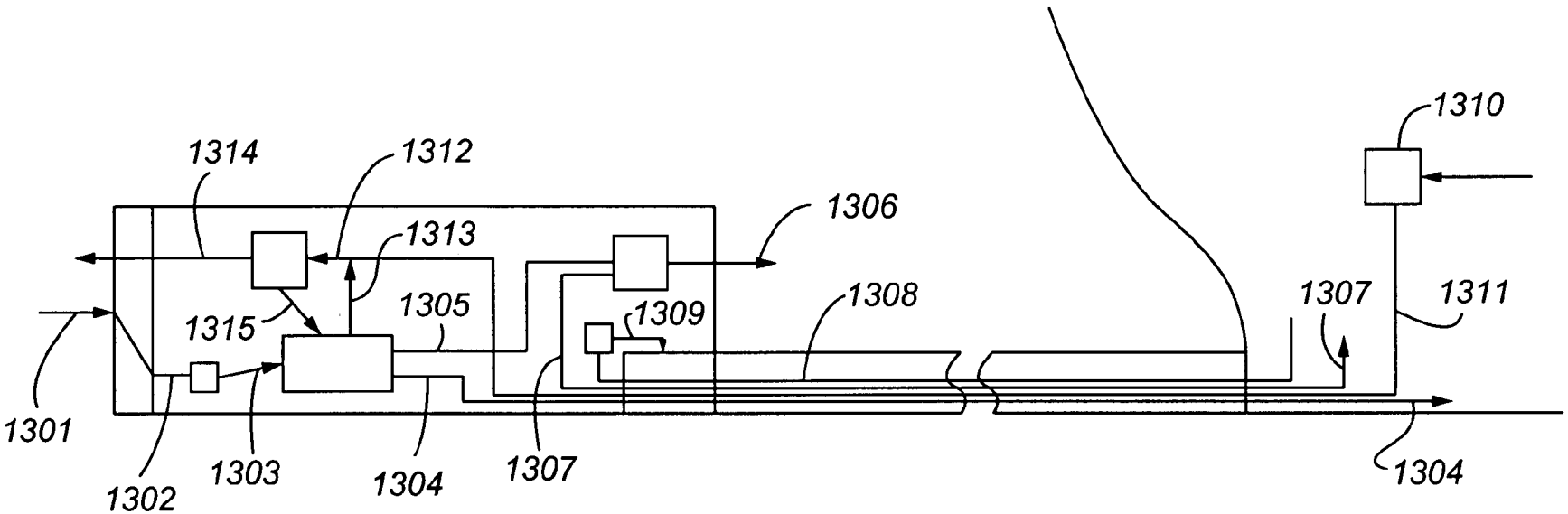
FIG. 13 schematically shows the principal material pathways of a preferred embodiment of the present invention with ore processing in the mining machine.

FIG. 13 schematically shows the principal material pathways of a preferred embodiment of the present invention with ore processing in the mining machine. The path of the ore is from the ore body as a water slurry 1301 through a conveyor mechanism such as, for example, a screw auger 1302 to a crusher. The crusher feeds the ore processor via path 1303. The bitumen froth produced by the ore processor is sent out of the access tunnel, for example, by a pipeline 1304 for treatment at an external froth treatment facility (not shown). The waste output of the ore processor is sent via 1305 to the backfill apparatus where most of it is emplaced as backfill via 1306. A portion of the waste material is sent out the access tunnel by pipeline of conveyor system for disposal at an external site (not shown). A concrete mix may be brought in by pipeline 1308 and distributed by path 1309 to form the access tunnel liner. As noted in U.S. Pat. No. 6,554,368, the tunnel liner may be formed by a number of known means, such, as for example, erecting concrete segments. External water is brought in along path 1310 to a holding tank and then into the mining machine via pipeline 1311 through the access tunnel. Water recovered by the ore processor is added to this input water via 1313 to form the total supply of water 1312 to the water heating and distribution apparatus. The water is supplied via path 1315 to the ore processor as needed and to the cutter head to form a cutting slurry via path 1314. The system is largely a closed loop system for water. New water is added via 1310 and small amounts of water are lost through path 1304 with the bitumen froth and through path 1305 with the waste stream.

External Processing Embodiment

An alternate embodiment of the present invention is to locate the principal ore extraction processing unit between the mining machine and the portal to the access tunnel or outside the portal. In this embodiment, the oil sands are excavated in the same manner as the first embodiment. In this embodiment of the invention, the density of the cutting slurry is in the range of approximately 1,100 kg/cu m to 1,800 kg/cu m which, in oil sands corresponds to a range of approximately 20% to 70% solids by mass. This is the same as the available density range of cutting slurries for the first embodiment.

If necessary, the excavated oil sands are then routed through a crusher to achieve a minimum fragment size required by an oil sands slurry transport system (also known as a hydrotransport system). This method of ore haulage is well-known and is recognized as the most cost and energy efficient means of haulage for oil sands ore. The civil TBM industry also utilizes slurry muck transport systems to remove the excavated material to outside of the tunnel being formed.

In oil sands hydrotransport systems, the slurry density operating range is typically between about 1,350 kg/cu m and 1,650 kg/cu m. In oil sands, it is typically more preferable to utilize a cutting slurry at the higher end of the slurry density range. The cutting slurry density may be selected without regard for the requirements of the hydrotransport systems because the hydrotransport systems requires a slurry feed which is typically below the density range of the preferred cutting slurry. Thus the ore slurry excavated by the mining machine can be matched to the requirements of the hydrotransport system by the addition of water before or after the crushing step.

The ore from the hydrotransport system can then be removed via the trailing access tunnel and delivered to a hydrocyclone processing facility, which includes at least one hydrocyclone, located near the portal of the access tunnel. The ore processing facility can be a fixed facility or a mobile facility that can be moved from time to time to maintain a relatively short hydrotransport distance.

In this alternate embodiment, the haulage distance for waste material is greater than the first embodiment but still considerably less than haulage distances typical of surface mining operations. A major portion of the waste from the processor facility must be returned to the mining machine for use as backfill. This can be accomplished by any number of conveyor systems well-known to the mining and civil tunneling industry. Mechanical conveyance allows the backfill material to be maintained in a low water condition suitable for backfill (no more than 20% by mass water). Slurry transport of the waste back to the mining machine is less preferable because the slurry would require the addition of water which would possibly make the backfill less stable for adjacent mining drives unless the backfill slurry were de-watered just prior to being emplaced as backfill. Other methods of returning the waste material from the hydrocyclone processing apparatus to the underground excavating machine for backfill include but are not limited to transport by an underground train operating on rails installed in the trailing access tunnel. It may also be possible to utilize an underground train to haul excavated ore from the underground excavating machine to the hydrocyclone processing apparatus.

Figure 14:
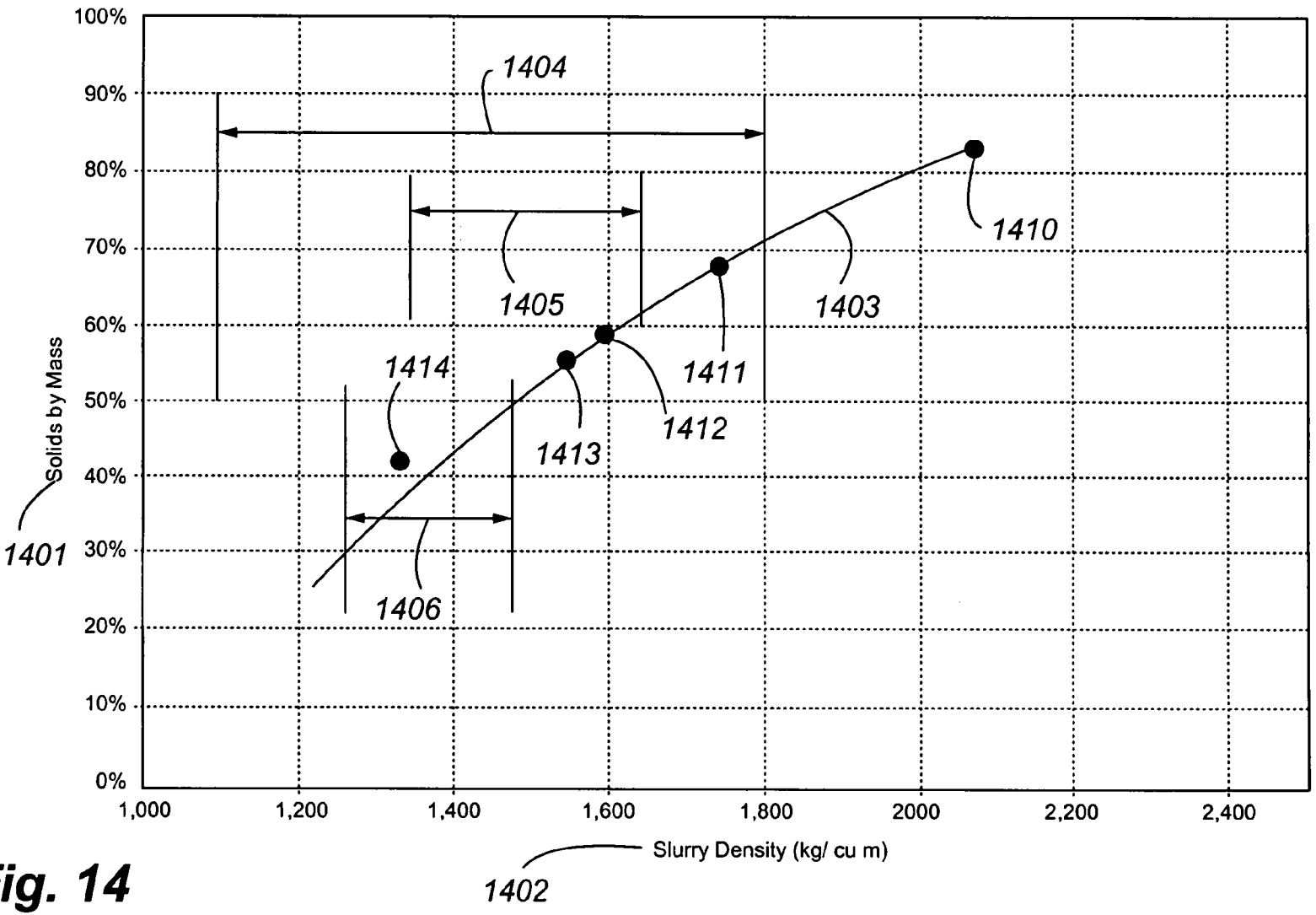
FIG. 14 shows a graph of the solids content by mass versus the density of a typical oil sands slurry illustrating a cutting slurry, a hydrotransport slurry and a processing slurry.

FIG. 14 shows a graph of the solids content by mass 1401 on the Y-axis versus the density of the oil sands slurry 1402 on the X-axis. The slurry density curve 1403 is for a typical oil sands ore (the same as described in the detailed discussion of FIG. 9). Slurry density decreases with addition of water which reduces the percentage of solids content. The practical range 1404 of cutting slurries for a slurry TBM or hydraulic mining machine is approximately between 1,100 kg per cu m and 1,800 kg per cu m, although wetter and drier slurries are within the state-of-the-art. The practical range 1405 for an oil sands hydrotransport slurry is approximately between 1,350 kg per cu m and 1,650 kg per cu m. Thus, there is a substantial range of excavation slurries that can be used that are higher in density than required by the feed for a hydrotransport system. The ore can be still excavated hydraulically or by slurry means and always require addition of water to form the feed for the hydrotransport slurry. A de-watering of the excavated ore slurry is not required. The optimum range of oil sands slurry mix tank densities 1406 for a hydrocyclone-based ore processor is shown as ranging from approximately 33% to about 50% solids by mass corresponding to a slurry density range of about 1,250 to approximately 1,500 kg per cu m. Thus, there is also a substantial range of hydrotransport slurries that can be used that are higher in density than required by the feed for a hydrocyclone-based processor. The ore can be hydrotransported and always require addition of water to form the feed for the processor. A de-watering of the hydrotransported ore slurry is not required. Thus there is a range of cutting and hydrotransport slurry densities in which the transition from cutting slurry to transport slurry is by the addition of water and the transition from transport slurry to processing slurry is also by the addition of water. As in the preferred embodiment illustrated in FIGS. 12 and 13, the only place in the entire mining system where a de-watering apparatus is required is within the ore processing apparatus and this is already known and practiced in the oil sands industry. The average composition of the mixture in the slurry feed tank discussed in FIG. 15 below is shown by location 1414 on curve 1403. The in-situ ore is shown as 1410; the excavation cutting slurry as 1411, the hydrotransport slurry as 1412 and the slurry tank feedstock as 1413. The mixture in the slurry tank 1414 includes the slurry feedstock 1413 as well as the overflow from one of the hydrocyclones. Since the overflow is richer in bitumen and water, the slurry mixture 1414 is not on the oil sand slurry curve 1403.

Figure 15:
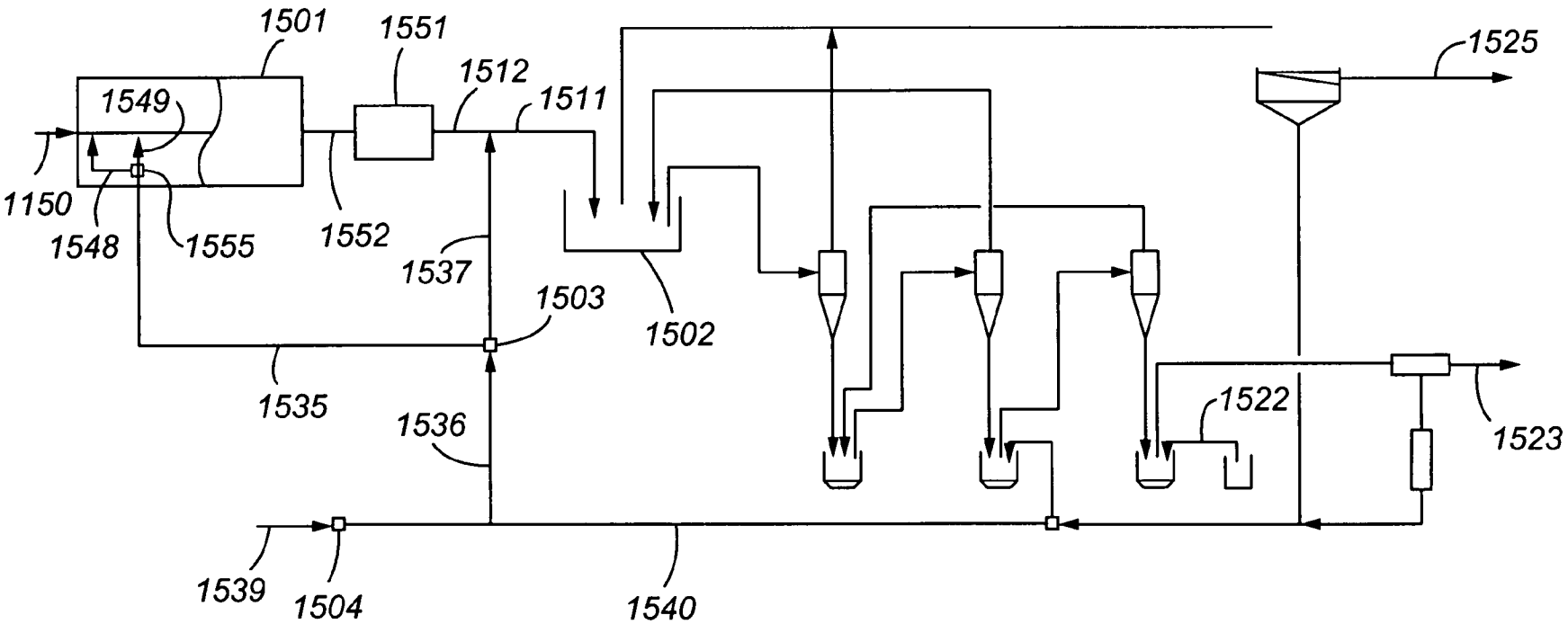
FIG. 15 shows flow chart of the elements of a hydrocyclone-based bitumen extraction unit as modified to accept the ore feed from a typical underground slurry excavating machine and hydrotransport system.

FIG. 15 shows flow chart of the elements of a hydrocyclone-based bitumen extraction unit as modified to accept the ore feed from a typical underground slurry excavating machine connected to the extraction unit by a hydrotransport system. The flow of material through the system is much like that outlined in the detailed description of FIGS. 8 and 11. The principal difference is the locations in the process illustrated in FIG. 15 where water is added. An input supply of water 1539 allocates water to a first water distribution apparatus 1503. The first water distribution apparatus 1503 allocates water 1535 as required to a slurry mining machine 1501. Here some water 1548 is added to mix with the in-situ ore 1550 to form a cutting slurry. Another portion of the water 1535 is added to the cutting slurry after being ingested by the mining machine 1501 to form a hydrotransport slurry 1552 to be fed into a hydrotransport system 1551. The hydrotransport system 1551 conveys the slurry 1512 where additional water 1537 is added to prepare the feed slurry 1511 for the hydrocyclone extraction system. The feed slurry 1511 is identical to the feed slurry 1111 of FIG. 11.

The mass flow rate balance (expressed as metric tonnes per hour) for FIG. 15 is presented below in Table 2. Most of the solids end up in the waste or tails stream 1523 which, for the present invention is largely used as backfill material. Most of the bitumen ends up in the product stream 1525. Ideally water is conserved. However some water is carried away in the bitumen froth product stream and some water is lost in the tails. Some water enters the system in the form of connate water associated with the in-situ oil sands. Some water is lost to the formation around the cutter head of the mining machine. Therefore, there is almost always a net input of water required. This is input via the input water supply 1539 which is externally obtained to make up for the net loss of water in the system. There is also a small input of water from the flocculent that may be added via stream 1522.

TABLE 2

| | Stream | | | | | |
|---|---|---|---|---|---|---|
| Tonnes per hour | 1511 Ore Feed to Slurry Tank | 1512 Slurry from Hydrotransport | 1513 Feed to 1st HydroCyc | 1514 underflow from 1st HydroCyc | 1515 Feed to 2nd HydroCyc | 1516 Overflow from 2nd HydroCyc |
| Bitumen | 241 | 241 | 124 | 37 | 49 | 34 |
| Water | 985 | 890 | 2,228 | 669 | 2,194 | 1,536 |
| Solids | 1,752 | 1,752 | 1,919 | 1,688 | 1,903 | 228 |
| Total | 2,978 | 2,883 | 4,271 | 2,394 | 4,146 | 1,798 |

| | Stream | | | | | |
|---|---|---|---|---|---|---|
| Tonnes per hour | 1517 underflow from 2nd HydroCyc | 1518 Feed to 3rd HydroCyc | 1519 Overflow from 3rd HydroCyc | 1520 underflow from 3rd HydroCyc | 1521 Discharge form 3rd Sump | 1522 Floccutant to 3rd Sump |
| Bitumen | 15 | 16 | 11 | 5 | 5 | 0 |
| Water | 658 | 2,179 | 1,525 | 654 | 656 | 2 |
| Solids | 1,675 | 1,882 | 215 | 1,667 | 1,667 | 0 |
| Total | 2,348 | 4,077 | 1,751 | 2,326 | 2,328 | 2 |

| | Stream | | | | | |
|---|---|---|---|---|---|---|
| Tonnes per hour | 1523 Tailings Waste | 1524 Overflow from 1st HydroCyc | 1525 Product from Decanter | 1526 Water from Vaccum Filter | 1527 | 1528 Froth Skimmed from Slurry Tank |
| Bitumen | 5 | 87 | 235 | 0 | | 151 |
| Water | 273 | 1,560 | 109 | 383 | | 293 |
| Solids | 1,667 | 230 | 83 | 0 | | 61 |
| Total | 1,945 | 1,877 | 427 | 383 | | 505 |

| | Stream | | | | | |
|---|---|---|---|---|---|---|
| Tonnes per hour | 1529 Makeup Water | 1530 Water from Separator | 1531 | 1532 Water to 2nd Sump | 1533 Input to Decanter | 1534 Water from Decanter |
| Bitumen | 0 | 0 | | 2 | 238 | 3 |
| Water | 279 | 383 | | 1,521 | 1,853 | 1,744 |
| Solids | 0 | 0 | | 207 | 291 | 207 |
| Total | 279 | 383 | | 1,730 | 2,382 | 1,954 |

| | Stream | | | | | |
|---|---|---|---|---|---|---|
| Tonnes per hour | 1535 Water to TBM | 1538 Water to 1st Distributor | 1537 Water from 1st Distributor | 1538 | 1539 | 1540 Water from 2nd Distributor |
| Bitumen | 0.5 | 1 | 0.5 | | | 1 |
| Water | 790 | 885 | 95 | | | 606 |
| Solids | 0 | 0 | 0 | | | 0 |
| Total | 791 | 886 | 96 | | | 607 |

TABLE 2-continued

| Tonnes per hour | Stream 1541 Water from Decanter and Separator | 1548 Water to Cutting Slurry | 1549 Water to Hydrotransport | 1560 In-situ Ore |
|---|---|---|---|---|
| Bitumen | 3 | 0.5 | 0 | 240 |
| Water | 2,127 | 500 | 290 | 100 |
| Solids | 207 | 0 | 20 | 1,752 |
| Total | 2,337 | 501 | 290 | 2,092 |

Table 2 is a mass flow rate balance, expressed in tonnes per hour (tph), for the mining system depicted in FIG. 15. The flow paths described for Table 2 are shown in FIG. 15. The amount of water sent to the mining machine cutter slurry and the amount of water added to the ore slurry may be varied to allow the cutting slurry to be optimized for the local ground conditions. In this example, 279 tph of make-up water is added via path 1529 to water recovered from the decanter 1506 and the tailings vacuum filter system 1510 to make available 885 tph of water for path 1536 that feeds the mining machine 1501 and the slurry tank 1502. The 279 tph of make-up water represents the amount of water that must be added to the system to make up for the principal water losses via the product stream 1525 (109 tph) and the tailings stream 1523 (273 tph). It is noted that there is some input of water to the system via the ore input 1550 in the form of connate water which is accounted for in path 1512 which includes both connate water and water added to form the cutting slurry. Table 2 shows 241 tph bitumen, 985 tph water and 1,752 tph solids (primarily quartz sand with some clay and shale) as feed to the slurry tank 1502.

In this example, 790 tph of water is sent to the TBM 1501, 500 tph of water is added to form the cutting slurry and 290 tph of water is subsequently added to form the hydrotransport slurry. Another 95 tph of water is added to the hydrotransport slurry to form the slurry feed for the slurry tank 1502. This example differs from that of FIG. 11 and Table 1 only in the way the water is allocated by distribution apparatus 1503. In the present example, more water is sent to the mining machine 1501 so as to be able to form the required hydrotransport slurry and less is sent via path 1537 to be added to the output of the hydrotransport slurry to form the feed slurry for the slurry tank 1502.

The net bitumen output from the decanter 1506 along path 1525 is 235 tph and the tailings output via path 1523 is comprised of 5 tph bitumen, 273 tph water and 1,667 tph solids waste (14% by mass water). In this example, the density of the cutting slurry is 1,715 kg per cu m, the density of the hydrotransport slurry 1512 is 1,597 kg per cu m and the density of the slurry feed 1511 to the slurry tank 1502 is 1,566 kg per cu m. In other words, water is added at each step in the excavating process, the transporting process and the preparation for the hydrocyclone extraction process. The only de-watering operation occurs at the end of the extraction process.

Figure 16:
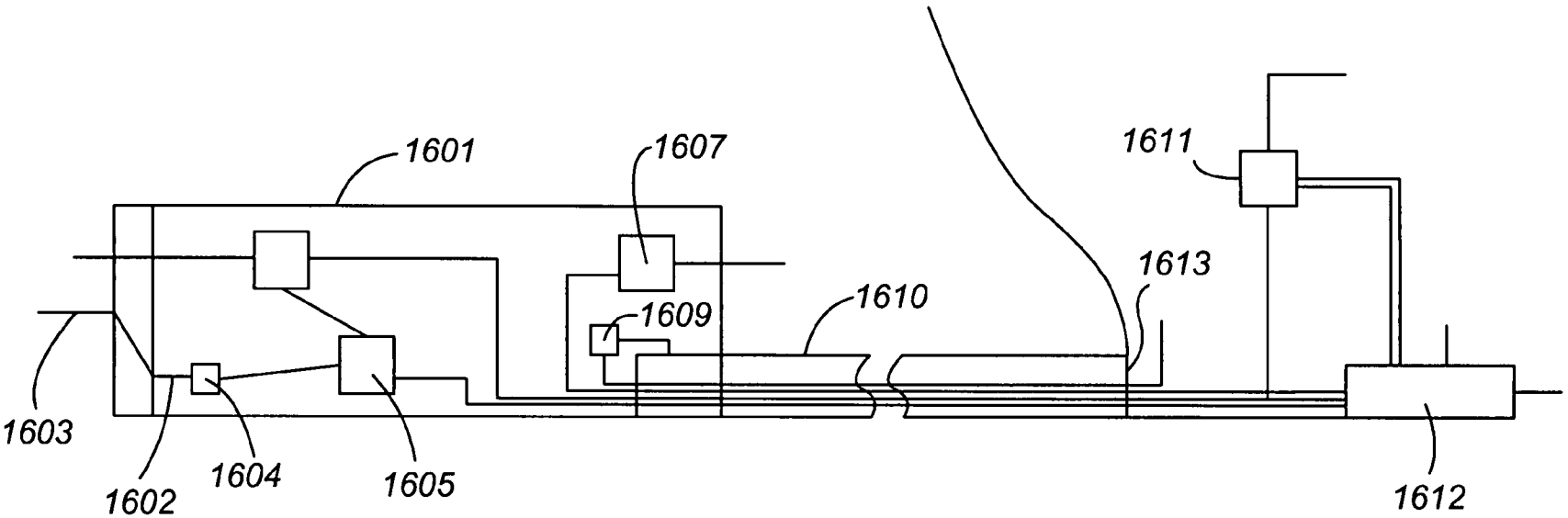
FIG. 16 schematically shows the basic components of an alternate embodiment of the present invention with ore processing outside the mining machine.

FIG. 16 schematically shows the basic components of an alternate embodiment of the present invention with ore processing outside the mining machine. The mining machine is enclosed in a shield 1601 and has an excavation head 1602 which excavates the ore 1603. The ore passes through the excavation or cutter head 1602 to a crusher 1604 and then to an apparatus 1605 that forms a hydrotransportable slurry. Water required by the process is input from a supply tank 1611 and is heated in the mining machine by a heat exchanger and distribution apparatus 1606. Backfill material 1608 is emplaced by a backfill apparatus 1607. The access tunnel liner 1610 is formed by, for example, concrete segments which are installed by a tunnel liner erector apparatus 1609. The hydrotransport slurry is fed into an ore processor facility 1612 which is located on the surface near the access tunnel portal 1613.

Figure 17:
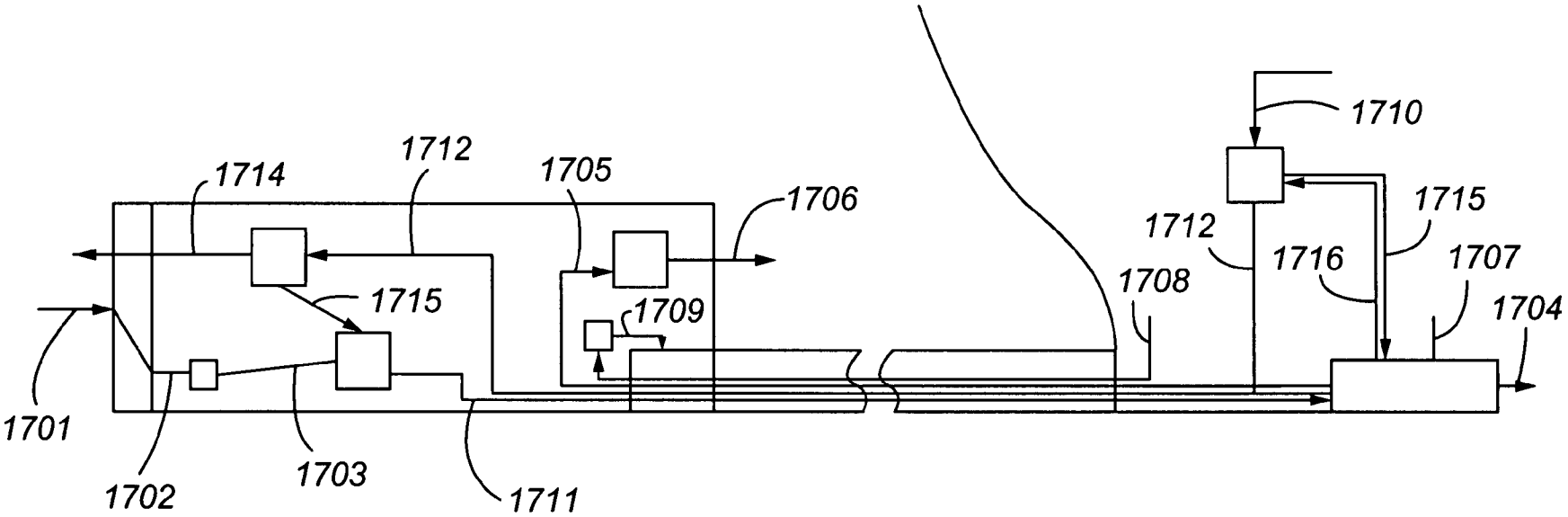
FIG. 17 schematically shows the principal material pathways of an alternate embodiment of the present invention with ore processing in the mining machine.

FIG. 17 schematically shows the principal material pathways of an alternate embodiment of the present invention with ore processing in the mining machine. The path of the ore is from the ore body as a water slurry 1701 through a conveyor mechanism such as, for example, a screw auger 1702 to a crusher. The crusher feeds an apparatus that forms a hydrotransportable slurry via path 1703. The hydrotransport slurry is sent out the access tunnel via pipeline 1711 and fed into an externally located ore processor. The bitumen froth produced by the ore processor is sent by a pipeline 1704 for treatment at an external froth treatment facility (not shown). The waste output of the ore processor is sent via a conveyance means such as for example a conveyor system 1705 to the backfill apparatus where most of it is emplaced as backfill via 1706. A portion of the waste material is sent via any number of conveyance means 1707 for disposal at an external site (not shown). A concrete mix may be brought in by pipeline 1708 and distributed by path 1709 to form the access tunnel liner. As noted in U.S. Pat. No. 6,554,368, the tunnel liner may be formed by a number of known means, such, as for example, erecting concrete segments. External water is brought in along path 1710 to a holding tank and then into the mining machine via pipeline 1712 through the access tunnel. Water recovered by the ore processor is added to the external water holding tank via pipeline 1716 to form the total supply of water 1712 to the water heating and distribution apparatus in the mining machine. The water is supplied via path 1715 to the ore processor as needed. Water is supplied to the cutter head to form a cutting slurry via path 1714. The system is largely a closed loop system for water. New water is added via 1710 and small amounts of water are lost through path 1704 with the bitumen froth and through path 1705 with the waste stream used for backfill and the excess waste stream 1707.

Selective Mining Embodiment

Another aspect of the present invention is to add a selective mining capability to the underground mining machine. This includes the ability to sense the ore quality ahead of the excavation. Once the ore is inside the mining machine, the ore grade must be determined before routing to the ore processing system or routing directly to backfill. In addition, it is more preferable to have an excavation process that can selectively excavate layers of reasonable grade ore from barren layers, rather than mix them, thereby lowering the overall ore grade. The present invention includes ways to selectively excavate and to determine ore grade before and after the excavation step. This in turn enables better control to be exercised over the processing step.

Another aspect of the present invention is that it can be applied to thin underground deposits in the range of about 8 to 20 meters as well as thicker deposits.

In another embodiment, a fully shielded mining machine is used that employs a different means of excavation than that of the rotary boring action of a tunnel boring machine or TBM. Such a machine might employ, for example, several rotary cutting drums where the cutting drums rotate around an axis perpendicular to the direction of excavation. These cutting drums would allow the ore to be excavated selectively if the feed from each drum or row of drums is initially maintained separately. Feed that is too low a grade for further processing can be directly routed to the backfill or to the de-water apparatus of the processing unit or to a waste slurry line for transport out to the surface. The ability to selectively mine a portion of the excavated material is not possible with current TBM technology. This alternate cutting method can be applied in a portion of the mining machine that is at or near local formation pressure and isolated from the personnel sections as discussed in U.S. Pat. No. 6,554,368.

In yet another embodiment utilizing a fully shielded mining machine, several rotary cutting heads can be used where the cutting heads rotate around axes parallel to the direction of excavation. These cutting heads would allow the ore to be excavated selectively if the feed from each head or row of heads is initially maintained separately. Feed that is too low a grade for further processing can be directly routed to the backfill or to the de-water apparatus of the processing unit or to a waste slurry line for transport out to the surface. The ability to selectively mine a portion of the excavated material is not possible with current TBM technology nor is it generally required. This alternate cutting method can be applied in a portion of the mining machine that is at or near local formation pressure and isolated from the personnel sections as discussed in U.S. Pat. No. 6,554,368.

In yet another embodiment, the front head of a fully shielded mining machine may utilize only water jets to excavate the oil sands ore and therefore the front head may not be required to rotate. The excavated material can be ingested through openings in the machine head by utilizing the pressure differential between the higher formation/cutting slurry and a chamber inside of the machine behind the front head.

Figure 18:
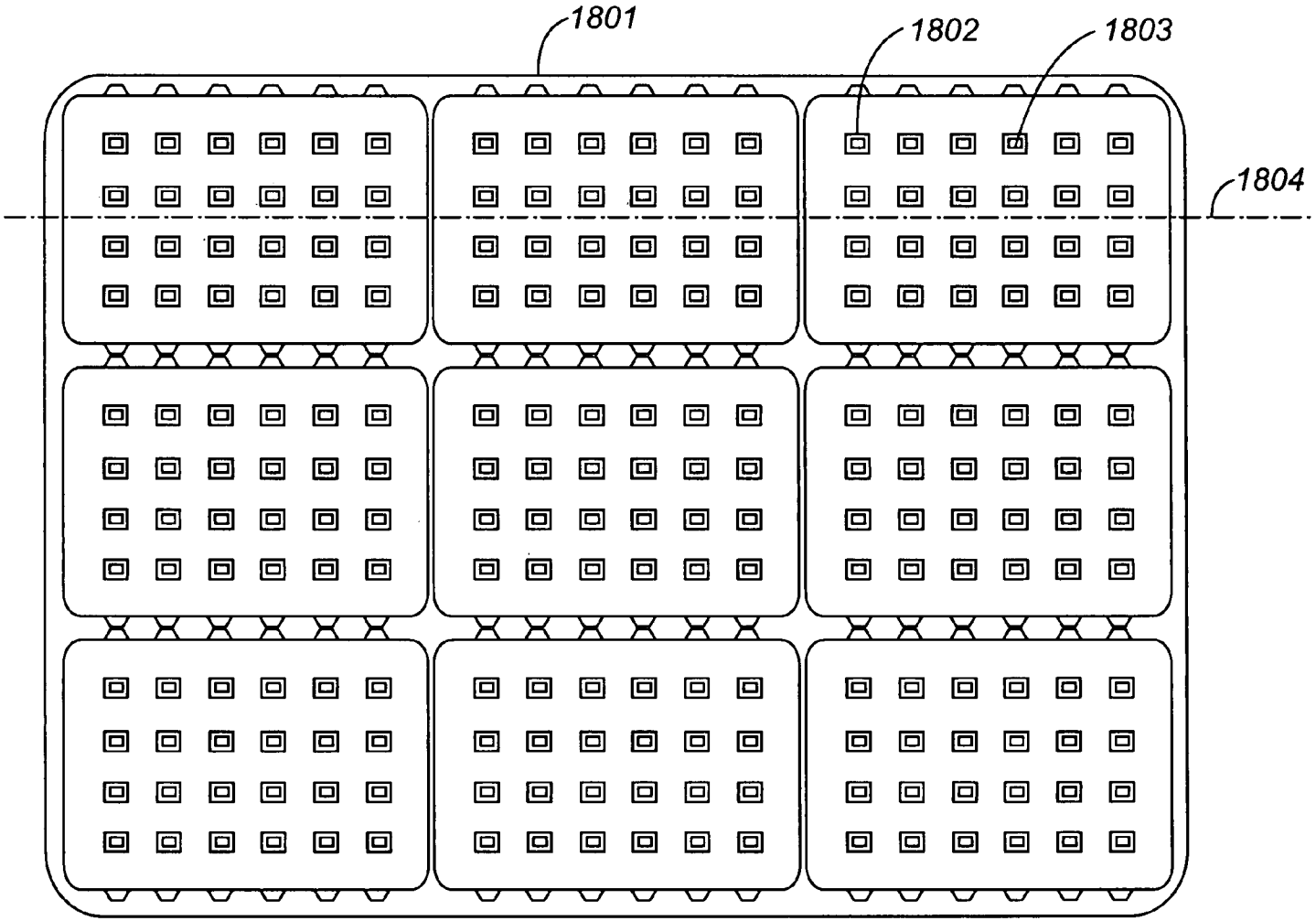
FIG. 18 shows a front view of a configuration of rotary cutter drums that can be used for selective mining in a fully shielded underground mining machine.

FIG. 18 shows a front view of a configuration of rotary cutter drums that can be used for selective mining in a fully shielded underground mining machine. The shield 1801 may be rectangular or oval or any other practical shape. It is preferable to have a nearly rectangular shape since the oil sands deposits are typically deposits that require many mining passes such as discussed in U.S. Pat. No. 6,554,368. As an example FIG. 18 shows an array of comprised of 9 drum cutter heads 1802. The diameter of the cutter drums 1802 are preferably in the range of 1 meter to 6 meters, more preferably in the range of 2 meters to 5 meters and most preferably in the range of 3 meters to 4 meters. The length of the cutter drums 1802 may be from the entire width of the mining machine to no less than a length-to-diameter ratio of two. The mining machine is more likely to encounter laterally deposited barren layers in the ore body so it is more important for there to be two or more rows of cutter drums than two of more columns of cutter drums. The cutter drums may have a variety of cutter elements 1803 such as known in the mining industry and such as may be modified to best operate in an abrasive sticky oil sands environment. For example, the cutter elements 1803 may be augmented with water jets. Alternately water jets may be located in the cutter drum 1802 between the cutter elements 1803. The cutter drums 1802 rotate about axes of rotation 1804 that are perpendicular to the direction of advancement of the mining machine. The cutter elements 1803 are installed in an array on the surface of the cutter drum 1802 so that they may or may not overlap or mesh with cutter elements on the cutter drums above or below.

Figure 19:
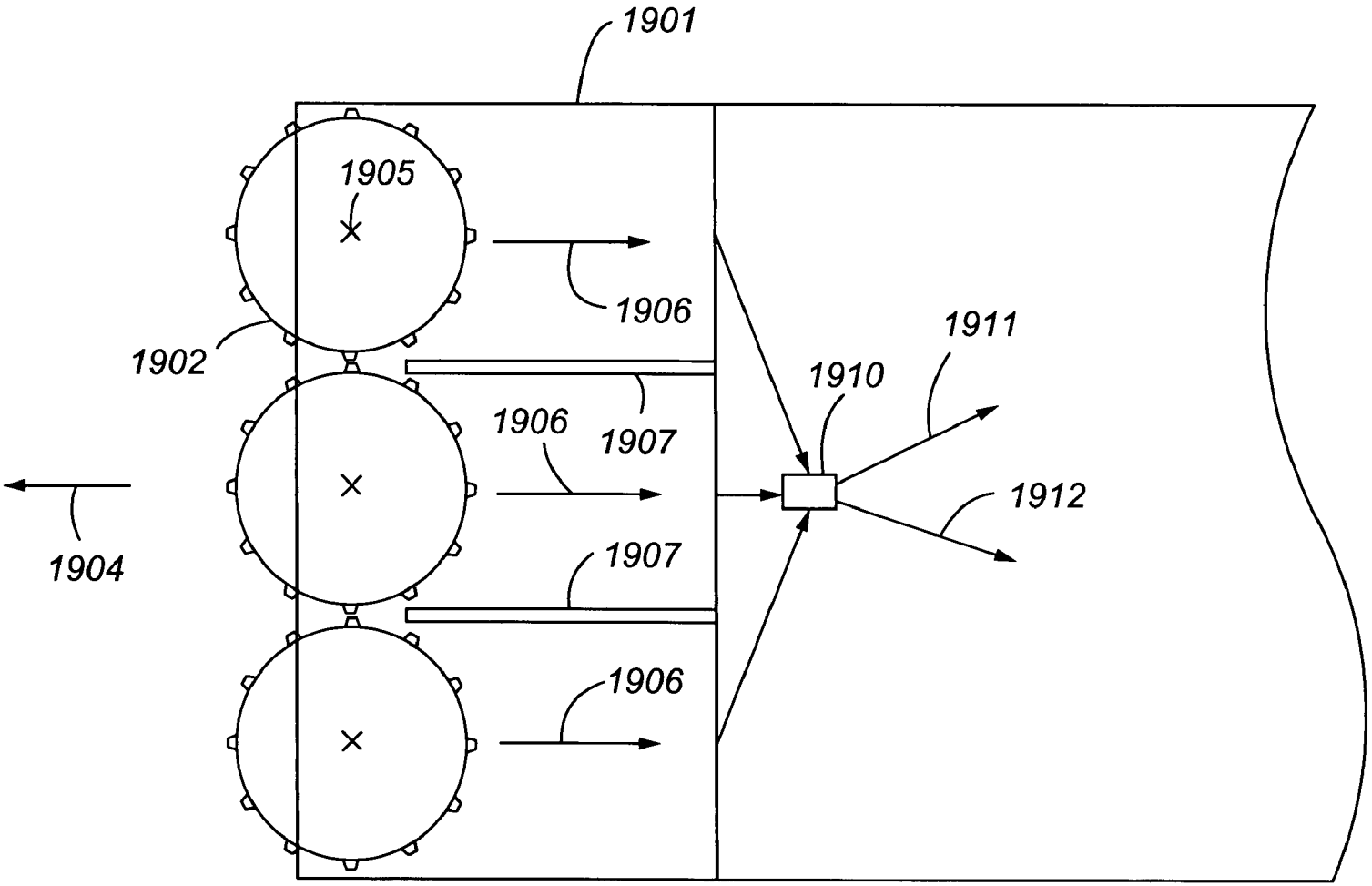
FIG. 19 shows a side view of multiple rows of cutting drums with the ability to selectively mine.

FIG. 19 shows a side view of multiple rows of cutter drums 1902 with the ability to selectively mine. The cutter drums 1902 are housed in the shield 1901 of the mining machine. The cutter drums 1902 may be contained completely within the shield 1901 or may protrude from the shield 1901 as shown in FIG. 19. The cutter drums 1902 rotate about axes of rotation 1905 that are perpendicular to the direction of advancement 1904 of the mining machine. The cutter elements or cutter tools 1903 are shown mounted on the outside of the cutter drums 1902. The oil sand ore is excavated by forming a slurry in front of the cutter drums. The ore slurry is ingested into the mining machine and channeled through an opening that is aligned 1906 with the row of the cutter drum or drums. Each row of cutter drums is separated by a barrier 1907 so that the ore from each row of cutter drums does not mix with the ore from the adjacent rows until it is evaluated for suitability as ore or waste. Similar barriers may be formed between adjacent cutter drums in a row if it is necessary to selectively mine the ore deposits laterally. This is generally not the case and selective mining is usually only required for vertical layers of the ore deposit. The ore may be analyzed by any number of well known methods to determine if the ore grade is suitable for further processing. If the ore is not deemed suitable for blending and further processing, it may be routed by a manually operated or automated switch 1910 directly to the backfill of the mining machine via a path 1912. If the ore is suitable for further processing it can be directed by switch 1910 to the ore processor or to the ore hydrotransport system via path 1911. In this case the ore may be mixed or blended into the other ore streams from the other openings 1906.

Figure 20:
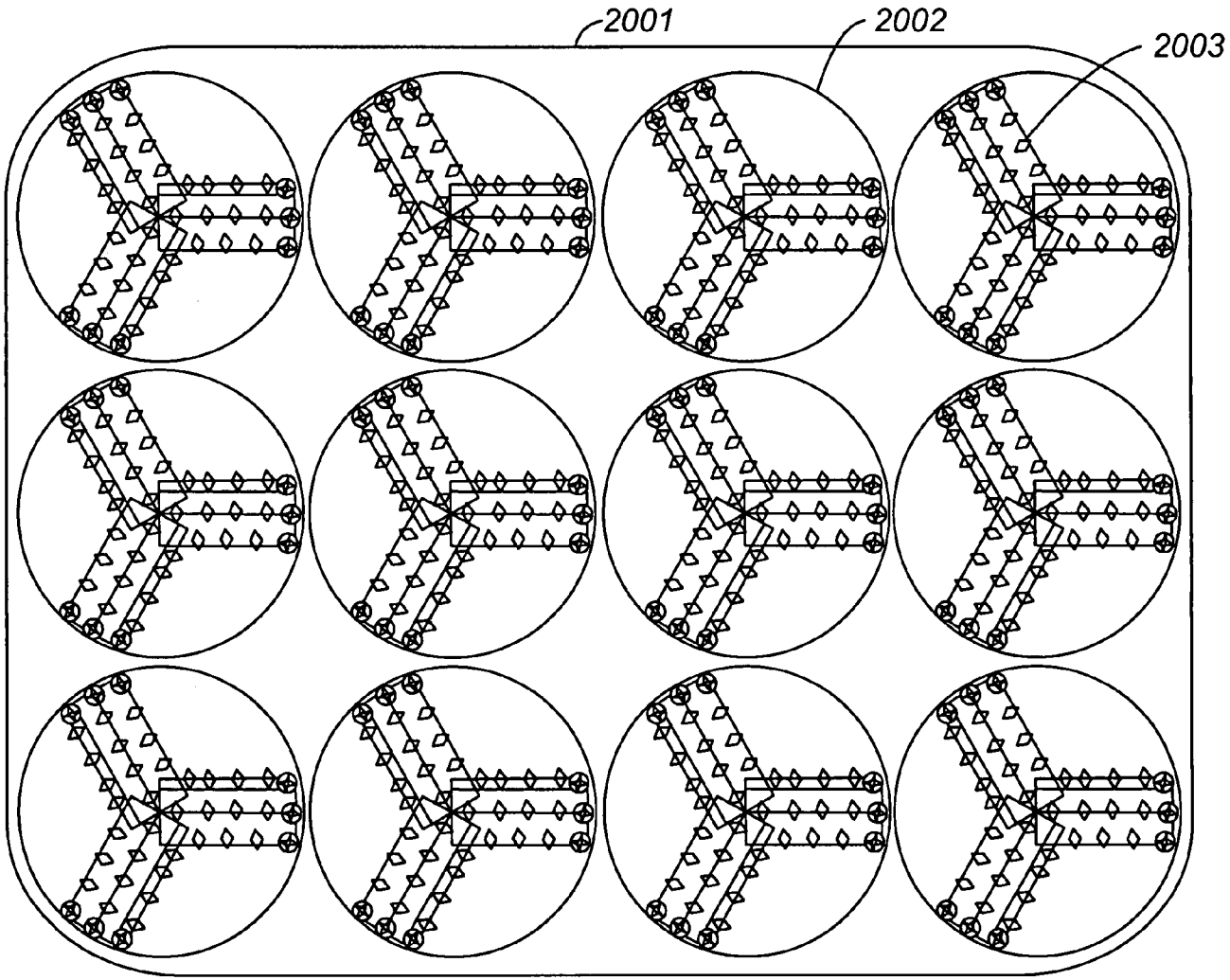
FIG. 20 shows a front view of a configuration of rotary cutter heads that can be used for selective mining in a fully shielded underground mining machine.

FIG. 20 shows a front view of a configuration of rotary cutter heads that can be used for selective mining in a fully shielded underground mining machine. The shield 2001 may be rectangular or oval or any other practical shape. It is preferable to have a nearly rectangular shape since the oil sands deposits are typically deposits that require many mining passes such as discussed in U.S. Pat. No. 6,554,368. As an example FIG. 20 shows an array of comprised of 12 rotary cutter heads 2002. The diameter of the cutter heads 2002 are preferably in the range of 1 meter to 6 meters, more preferably in the range of 2 meters to 5 meters and most preferably in the range of 3 meters to 4 meters. The width-to-diameter of the front of the mining machine is preferably in the range of 1 to 6 and more preferably in the range of 1.5 to 4. The mining machine is more likely to encounter laterally deposited barren layers in the ore body so it is more important for there to be two or more rows of cutter heads than two of more columns of cutter heads. The cutter heads may have a variety of cutter elements 2003 such as known in the mining and/or tunneling industries and such as may be modified to best operate in an abrasive sticky oil sands environment. For example, the cutter elements 2003 may be augmented with water jets. Alternately water jets may be located in the cutter head 2002 between the cutter elements 2003. The cutter heads 2002 rotate about axes of rotation that are parallel to the direction of advancement of the mining machine. The manner in which this configuration of cutter heads does selective mining is analogous to that of the cutter drums depicted in FIGS. 18 and 19. That is the ore excavated by each cutter head or each row of cutter heads may be processed separately so that barren material or low grade ore may be rejected and ore of economical grade may be accepted and blended inside the mining machine. While these cutter heads may be constructed from methods developed by the tunnel boring machine industry, the function of selective excavation is not. A machine such as described in part by FIG. 20 is therefore conceived as a mining machine and not a tunneling machine.

A number of variations and modifications of the invention can be used. It would be possible to provide for some features of the invention without providing others. The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for selective underground mining, comprising:

excavating a material with a plurality of excavating devices, each excavating device being in communication with and providing excavated material to a separate input for the excavated material, wherein the excavating devices do not rotate about a common axis maintained in a substantially constant position relative to the material to be excavated and wherein the plurality of excavating devices comprise first and second sets of excavating devices;

directing first and second streams of the excavated material into corresponding first and second inputs, the first input being associated with at least a first excavating device in the first set and the second input being associated with at least a second excavating device in the second set, wherein a barrier separates the at least a first excavating device from the at least a second excavating device;

determining a respective value of each of the first and second streams, wherein the respective value is indicative of a valuable mineral content of the material;

when a first value of the first stream is significant, selectively directing the first stream from the first input to a first location for recovery of the valuable mineral content in at least a portion of the first stream;

when a first value of the first stream is not significant, selectively directing the first stream from the first input to a backfill apparatus to backfill at least a portion of the first stream;

when a second value of the second stream is significant, selectively directing the second stream from the second input to the first location for recovery of the valuable mineral content in at least a portion of the second stream; and when a second value of the second stream is not significant, selectively directing the second stream from the second input to the backfill apparatus to backfill at least a portion of the second stream, wherein the barrier maintains the first and second streams from contacting one another before the selectively directing steps.

2. The method of claim 1, wherein at least some of the material is a hydrocarbon-containing material and wherein the respective value is related to a bitumen content of the material.

3. The method of claim 1, wherein the first location is a processing device to extract a valuable material and wherein the plurality of excavating devices are independently rotatable from one another.

4. The method of claim 1, further comprising:

at a first time, determining that the first stream has a significant value and directing the first stream to the first location; and at a second later time, determining that the first stream does not have a significant value and directing the first stream to the backfill apparatus.

5. The method of claim 1, wherein the plurality of excavating devices are a plurality of rotary excavating heads.

6. The method of claim 1, wherein the plurality of excavating devices are a plurality of water jets.

7. The method of claim 1, wherein the first excavating device is located above the second excavating device.

8. An underground mining machine, comprising:

a plurality of excavating devices operable to excavate a material;

a plurality of separate inputs, each input being in communication with a corresponding one of the plurality of excavating devices, wherein first and second streams of the excavated material are directed into first and second inputs corresponding to first and second excavating devices;

an analyzer operable to determine a respective value of each of the first and second streams, wherein the respective value is indicative of a valuable mineral content of the material;

a switch operable to (a) when a first value of the first stream is significant, selectively direct the first stream from the first input to a first location for recovery of the valuable mineral content in at least a portion of the first stream; (b) when a first value of the first stream is not significant, selectively direct the first stream from the first input to a backfill apparatus to backfill at least a portion of the first stream; (c) when a second value of the second stream is significant, selectively direct the second stream from the second input to the first location for recovery of the valuable mineral content in at least a portion of the second stream; and (d) when a second value of the second stream is not significant, selectively direct the second stream from the second input to the backfill apparatus to backfill at least a portion of the second stream, wherein the plurality of excavating devices and the plurality of corresponding inputs are arranged in a plurality of rows and columns and wherein said plurality of rows comprise a first and second rows of cutter drums, and further comprising:

a barrier separating said first and second rows of cutter drums such that ore processed by at least one cutter drum in the first row of cutter drums does not contact ore processed by at least one cutter drum in the second row of cutter drums.

9. The underground mining machine of claim 8, wherein at least some of the material is a hydrocarbon-containing material and wherein the respective value is related to a bitumen content of the material.

10. The underground mining machine of claim 8, wherein the first location is a processing device to extract a valuable material from the excavated material.

11. The underground mining machine of claim 8, wherein the switch, at a first time, determines that the first stream has a significant value and directs the first stream to the first location and at a second later time, determines that the first stream does not have a significant value and directs the first stream to the backfill apparatus.

12. The underground mining machine of claim 8, wherein the plurality of excavating devices are a plurality of rotary excavating heads.

13. The underground mining machine of claim 8, wherein the plurality of excavating devices are a plurality of water jets.

14. The underground mining machine of claim 8, the first excavating device is located above the second excavating device.

15. The method of claim 1, wherein said step of determining is preformed by positioning a sensor along a path of the first and second streams.

16. The underground mining machine of claim 8, wherein said analyzer includes a sensor positioned along a path of the first and second streams to determine a valuable mineral content of the first and second streams as the streams flow past the sensor.

17. The method of claim 1, wherein each of the plurality of excavating devices is a rotatable cutter drum and wherein the rotatable cutter drums rotate about a different axis.

18. The method of claim 1, wherein each of the plurality of excavating devices remain in a constant location relative to a direction of excavation.

19. The method of claim 1, wherein each of the excavating devices is maintained in a substantially constant position relative to the material to be excavated.

* * * * *